US010634103B2

(12) United States Patent
Imai

(10) Patent No.: US 10,634,103 B2
(45) Date of Patent: Apr. 28, 2020

(54) FUEL INJECTION VALVE AND FUEL INJECTION SYSTEM

(71) Applicant: DENSO CORPORATION, Kariya, Aichi-pref. (JP)

(72) Inventor: Keita Imai, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/539,292

(22) Filed: Aug. 13, 2019

(65) Prior Publication Data

US 2019/0360443 A1 Nov. 28, 2019

Related U.S. Application Data

(63) Continuation of application No. PCT/JP2018/005448, filed on Feb. 16, 2018.

(30) Foreign Application Priority Data

Mar. 3, 2017 (JP) ..... 2017-040728
Nov. 7, 2017 (JP) ..... 2017-214957

(51) Int. Cl.
*F02M 51/06* (2006.01)

(52) U.S. Cl.
CPC ..... *F02M 51/0614* (2013.01)

(58) Field of Classification Search
CPC ..... F02D 41/2096; F02M 51/061; F02M 51/0614; F02M 51/0632
USPC ..... 123/490; 239/585.1, 585.4, 585.5, 900; 361/154, 155
See application file for complete search history.

(56) References Cited

U.S. PATENT DOCUMENTS

| | | | | |
|---|---|---|---|---|
| 6,032,879 | A | 3/2000 | Hamada et al. | |
| 2005/0006492 | A1 | 1/2005 | Brooks et al. | |
| 2014/0238354 | A1* | 8/2014 | Imai | F02D 41/20 123/478 |
| 2016/0061139 | A1* | 3/2016 | Imai | F02D 41/3845 123/294 |
| 2017/0226950 | A1* | 8/2017 | Tanaka | F02D 41/20 |
| 2019/0277236 | A1* | 9/2019 | Harada | F02M 61/1806 |
| 2019/0277237 | A1* | 9/2019 | Imai | F02M 61/1833 |

FOREIGN PATENT DOCUMENTS

| | | |
|---|---|---|
| WO | 2018/0159325 | 9/2018 |
| WO | 2018/0159327 | 9/2018 |

OTHER PUBLICATIONS

U.S. Appl. No. 16/539,223 to Saizen, et al., filed Aug. 13, 2019 (59 pages).

(Continued)

*Primary Examiner* — John Kwon
(74) *Attorney, Agent, or Firm* — Nixon & Vanderhye P.C.

(57) ABSTRACT

In a fuel injection valve, a movable structure includes: a movable core that includes a first attractive surface and a second attractive surface, which are configured to be attracted toward at least one stationary core when a coil is energized; and an elongated shaft member that has a length, which is measured in a moving direction of the movable structure and is larger than a length of the movable core, which is measured in the moving direction. A modulus of longitudinal elasticity of the elongated shaft member is larger than a modulus of longitudinal elasticity of the movable core.

21 Claims, 9 Drawing Sheets

(56) References Cited

OTHER PUBLICATIONS

U.S. Appl. No. 16/539,321 to Saizen, et al., filed Aug. 13, 2019 (64 pages).
U.S. Appl. No. 16/539,223, filed Aug. 13, 2019, Fuel Injection Valve.
U.S. Appl. No. 16/539,292, filed Aug. 13, 2019, Fuel Injection Valve and Fuel Injection System.
U.S. Appl. No. 16/539,321, filed Aug. 13, 2019, Fuel Injection Valve and Method for Manufacturing Fuel Injection Valve.

* cited by examiner

FUEL INJECTION VALVE AND FUEL INJECTION SYSTEM

CROSS REFERENCE TO RELATED APPLICATIONS

This application is a continuation application of International Patent Application No. PCT/JP2018/005448 filed on Feb. 16, 2018, which designated the U.S. and claims the benefit of priority from Japanese Patent Application No. 2017-40728 filed on Mar. 3, 2017 and Japanese Patent Application No. 2017-214957 filed on Nov. 7, 2017. The entire disclosures of all of the above applications are incorporated herein by reference.

TECHNICAL FIELD

The present disclosure relates to a fuel injection valve, which is configured to inject fuel from an injection hole thereof, and a fuel injection system.

BACKGROUND

A previously proposed fuel injection valve, which injects fuel from an injection hole, includes a stationary core and a movable core, which form a passage of a magnetic flux that is generated through energization of a coil. The movable core includes an attractive surface, which is opposed to the stationary core. A magnetic force is applied from the stationary core to the movable core through an air gap formed between the attractive surface of the movable core and the stationary core, so that the movable core is moved. In this way, a valve element, which is attached to the movable core, is driven to open and close the injection hole, and thereby injection of the fuel is enabled and disabled.

SUMMARY

According to the present disclosure, there is provided a fuel injection valve. In the fuel injection valve, a movable structure includes: a movable core that includes a first attractive surface and a second attractive surface, which are configured to be attracted toward a stationary core when a coil is energized; and an elongated shaft member that has a length, which is measured in a moving direction of the movable structure and is larger than a length of the movable core, which is measured in the moving direction. A modulus of longitudinal elasticity of the elongated shaft member is larger than a modulus of longitudinal elasticity of the movable core.

BRIEF DESCRIPTION OF DRAWINGS

The present disclosure, together with additional objectives, features and advantages thereof, will be best understood from the following description in view of the accompanying drawings.

DETAILED DESCRIPTION

Figure 1:
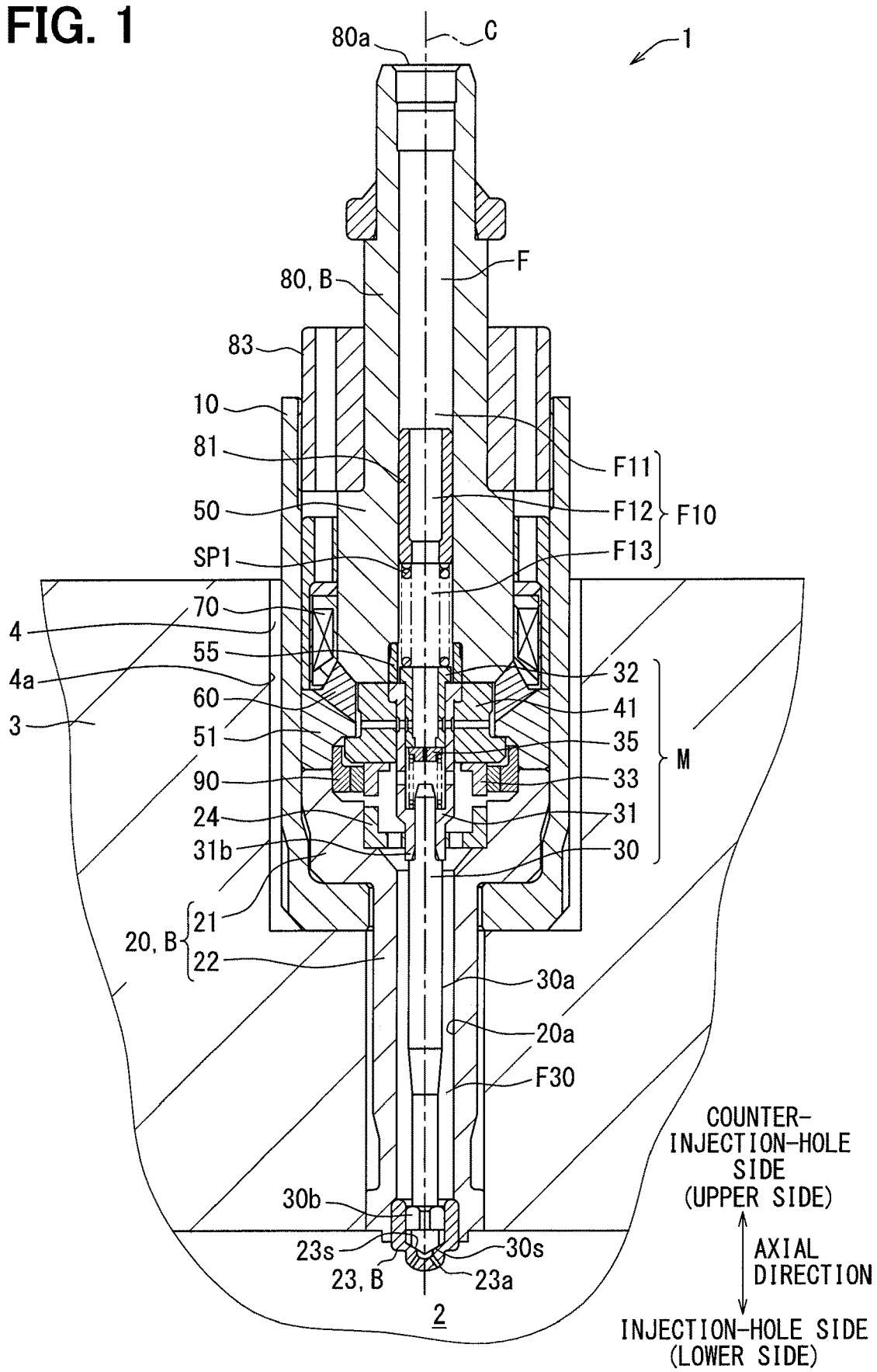
FIG. 1 is a cross-sectional view of a fuel injection valve according to a first embodiment of the present disclosure.

Lately, a demanded injection pressure of a fuel injection valve has been significantly increased. In response to the increase in the fuel pressure, a required magnetic force, which is required to move a movable core, is also increased. In a previously proposed fuel injection valve, two attractive surfaces are formed at the movable core, so that a magnetic force, which is applied to the movable core, is increased. The two attractive surfaces are formed at different locations, respectively, which are different from each other in the moving direction of the movable core. In a magnetic flux passage, a magnetic flux, which enters the movable core through one of the two attractive surfaces, exits from the movable core through the other one of the two attractive surfaces.

Specifically, in a case of a movable core that has a single attractive surface, a magnetic flux, which enters the movable core through the attractive surface, exits from the movable core through a peripheral surface of the movable core. Therefore, the peripheral surface does not function as the attractive surface. In contrast, in a case where the movable core includes the two attractive surfaces like the movable core of the previously proposed fuel injection valve, the movable core can be moved by a magnetic force, which is generated by the magnetic flux entering the movable core, and a magnetic force, which is generated by the magnetic flux exiting from the movable core. Therefore, it is possible to generate a large magnetic force, which can meet the demand for the high pressurization.

However, in the case where the movable core includes the two attractive surfaces, which are respectively formed at the different locations that are difference from each other in the moving direction of the movable core, a size of the movable core is increased in comparison to the case where the movable core includes the single attractive surface. Therefore, there is a disadvantageous increase in a mass of a movable structure that includes a valve element, which opens and closes the injection hole, and the movable core. As a result, the movable structure is more likely to have the following bouncing phenomenon. Specifically, when the valve element is seated against the seatable surface through the valve closing movement of the movable structure, the valve element collides against the seatable surface and is bounced from the seatable surface, and this process of seating and bouncing is repeated.

According to one aspect of the present disclosure, there is provided a fuel injection valve including: a coil that is configured to generate a magnetic flux when the coil is energized; a stationary core that is configured to form a passage of the magnetic flux and thereby generate a magnetic force; and a movable structure that includes a first attractive surface and a second attractive surface, which are configured to be attracted toward the stationary core by the magnetic force, wherein the movable structure is configured to be driven to open or close an injection hole, and the injection hole is configured to inject fuel when the movable structure is moved to open the injection hole in response to attraction of the first attractive surface and the second attractive surface toward the stationary core, wherein: the first attractive surface and the second attractive surface are located at different locations, respectively, which are different from each other in a moving direction of the movable structure; the movable structure includes: a movable core that includes the first attractive surface and the second attractive surface; and an elongated shaft member that has a length, which is measured in the moving direction and is larger than a length of the movable core, which is measured in the moving direction; and a modulus of longitudinal elasticity of the elongated shaft member is larger than a modulus of longitudinal elasticity of the movable core.

In a vibration model at the time of bouncing the movable structure, a time period, which is required for the attenuation of the vibration, is reduced when a natural frequency of the movable structure is increased, so that this is effective for limiting the bouncing. The natural frequency of the movable structure decreases as a length of the movable structure in the vibrating direction increases, while the natural frequency of the movable structure increases as the modulus of longitudinal elasticity increases. Therefore, it is effective to increase the modulus of longitudinal elasticity of the long portion of the movable structure, which has a long length in the vibrating direction, to decrease the vibration attenuation time period and thereby to limit the bouncing of the movable structure.

According to the above aspect that is made in view of this point, the modulus of longitudinal elasticity of the elongated shaft member is larger than the modulus of longitudinal elasticity of the movable core. Therefore, the bouncing can be more effectively limited in comparison to a case where the modulus of longitudinal elasticity of the entire movable structure is set to be the same as the modulus of longitudinal elasticity of the movable core. Furthermore, the movable core, which forms the first attractive surface and the second attractive surface, can be made of the ferromagnetic material, through which the magnetic flux can easily pass, without having a restriction such as increasing of the modulus of longitudinal elasticity. Thus, it is possible to achieve both of the increasing of the magnetic force and the limiting of the bouncing.

Hereinafter, embodiments of the present disclosure will be described with reference to the drawings. In the following respective embodiments, corresponding structural elements are indicated by the same reference signs and may not be redundantly described in some cases. In a case where only a part of a structure is described in each of the following embodiments, the rest of the structure of the embodiment may be the same as that of previously described one or more of the embodiments. Besides the explicitly described combination(s) of structural components in each of the following embodiments, the structural components of different embodiments may be partially combined even though such a combination(s) is not explicitly explained as long as there is no problem. It should be understood that the unexplained combinations of the structural components recited in the following embodiments and modifications thereof are assumed to be disclosed in this description by the following explanation.

First Embodiment

A fuel injection valve 1 shown in FIG. 1 is installed to a gasoline engine (serving as an ignition internal combustion engine) and directly injects fuel into a corresponding combustion chamber 2 of the engine that is a multicylinder type. Specifically, an installation hole 4, into which the fuel injection valve 1 is inserted, is formed at a cylinder head 3, which forms the combustion chamber 2, such that the installation hole 4 is placed at a location that coincides with an axis C of the cylinder. The fuel to be supplied to the fuel injection valve 1 is pumped by a fuel pump (not shown) that is driven by a rotational drive force of the engine. The fuel injection valve 1 includes a case 10, a nozzle body 20, a valve element 30, a movable core 41, stationary cores 50, 51, a non-magnetic member 60, a coil 70 and a pipe connecting portion 80.

The case 10 is made of metal and is shaped into a cylindrical tubular form that extends in an axial direction of a center line C of the coil 70 that is shaped into a ring form. The center line C of the coil 70 coincides with a central axis of the case 10, the nozzle body 20, the valve element 30, the movable core 41, the stationary cores 50, 51 and the non-magnetic member 60.

The nozzle body 20 is made of metal and includes: a body main portion 21 that is inserted into and is engaged with the case 10; and a nozzle portion 22 that extends from the body main portion 21 to the outside of the case 10. The body main portion 21 and the nozzle portion 22 are respectively shaped into a cylindrical tubular form that extends in the axial direction. An injection hole member 23 is installed to a distal end of the nozzle portion 22.

The injection hole member 23 is made of metal and is securely welded to the nozzle portion 22. The injection hole member 23 is a bottomed cylindrical tubular form that extends in the axial direction. An injection hole 23*a*, which injects the fuel, is formed at a distal end of the injection hole member 23. A seatable surface 23*s* is formed at an inner peripheral surface of the injection hole member 23, and the valve element 30 can be lifted from and seated against the seatable surface 23*s*.

The valve element 30 is made of metal and is shaped into a cylindrical columnar form that extends in the axial direction. The valve element 30 is installed in an inside of the nozzle body 20 in a state where the valve element 30 is movable in the axial direction. A flow passage, which is in an annular form and extends in the axial direction, is formed between an outer peripheral surface 30*a* of the valve element 30 and an inner peripheral surface 20*a* of the nozzle body 20. This flow passage will be referred to as a downstream flow passage F30. A seat surface 30*s* is formed at an end portion of the valve element 30 located on the injection hole 23*a* side, and the seat surface 30*s* is in a ring form and can be seated against and lifted away from the seatable surface 23*s*.

A coupling member 31 is joined to a counter-injection-hole side end portion of the valve element 30, which is opposite to the injection hole 23*a*, by for example, welding. Furthermore, an orifice member 32 and the movable core 41 are installed to a counter-injection-hole side end portion of the coupling member 31.

Figure 2:
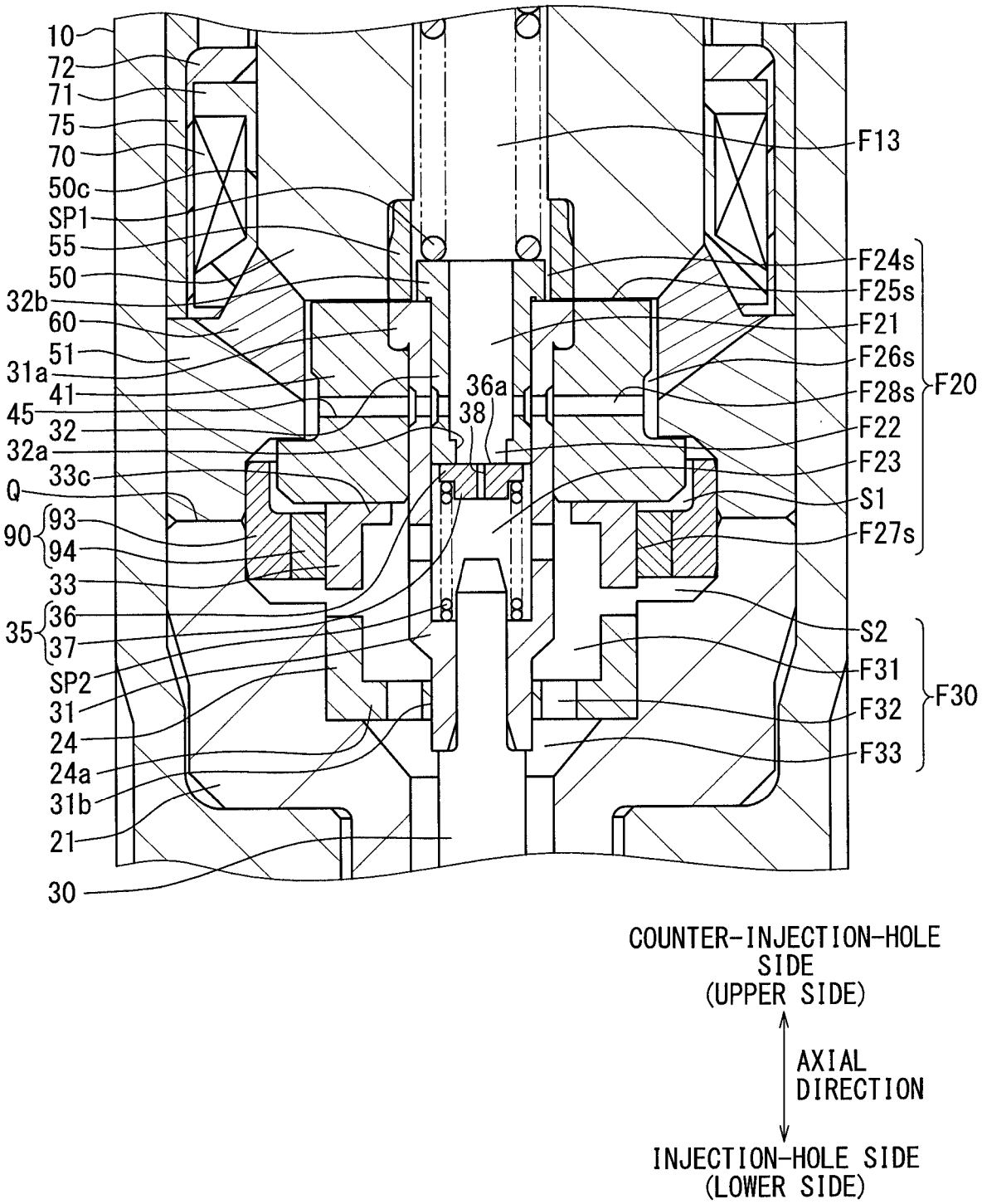
FIG. 2 is an enlarged view showing an area around a movable core shown in FIG. 1.
Figure 3:
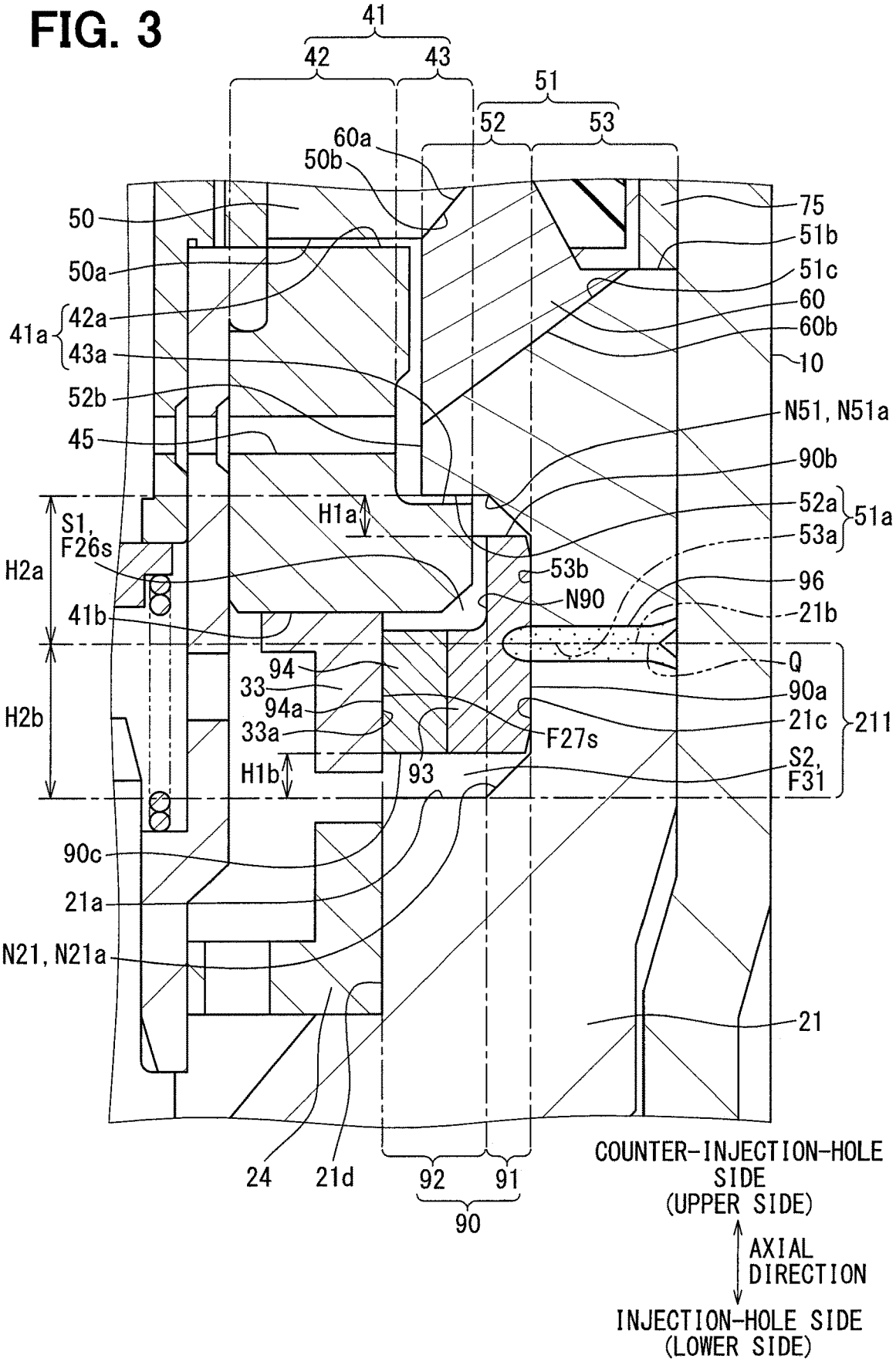
FIG. 3 is an enlarged view of an area around a cover body shown in FIG. 1.

As shown in FIGS. 2 and 3, the coupling member 31 is shaped into a cylindrical tubular form and extends in the axial direction while an inside of the coupling member 31 serves as a flow passage F23 that conducts the fuel. The orifice member 32 is fixed to a cylindrical inner peripheral surface of the coupling member 31 by, for example, welding. The movable core 41 is fixed to a cylindrical outer peripheral surface of the coupling member 31 by, for example, welding. An enlarged diameter portion 31*a*, a diameter of which is increased in the radial direction, is formed at the counter-injection-hole side end portion of the coupling member 31.

An injection-hole-side end surface of the enlarged diameter portion 31*a* is engaged with the movable core 41, so that removal of the coupling member 31 from the movable core 41 toward the injection-hole side is limited.

The orifice member 32 is shaped into a cylindrical tubular form and extends in the axial direction while an inside of the orifice member 32 serves as a flow passage F21 that conducts the fuel. An orifice 32*a* is formed at an injection-hole-side end portion of the orifice member 32. A passage cross-sectional area of a portion of the flow passage F21 at the orifice 32*a* is partially narrowed, so that the orifice 32*a* serves as a flow restricting portion that restricts a flow rate of the fuel. The portion of the flow passage F21, at which the passage cross-sectional area is narrowed by the orifice 32*a*, is referred to as a restricting flow passage F22.

The restricting flow passage F22 is located along a central axis of the valve element 30. A passage length of the restricting flow passage F22 is smaller than a diameter of the restricting flow passage F22. An enlarged diameter portion 32*b*, which is enlarged in the radial direction, is formed at the counter-injection-hole side end portion of the orifice member 32. An injection-hole-side end surface of the enlarged diameter portion 32*b* is engaged with the coupling member 31, so that removal of the orifice member 32 from the coupling member 31 toward the injection-hole side is limited.

The movable structure M includes a movable member 35 and a resilient urging member SP2. The movable member 35 is placed in the flow passage F23 at the inside of the coupling member 31 such that the movable member 35 is movable in the axial direction relative to the orifice member 32.

The movable member 35 is shaped into a cylindrical columnar form extending in the axial direction and is made of metal, and the movable member 35 is placed on the downstream side of the orifice member 32. A through-hole extends through a center part of the movable member 35 in the axial direction. This through-hole is a portion of the flow passage F and is communicated with the restricting flow passage F22, and this through-hole serves as a sub-restricting passage 38 that has a passage cross-sectional area, which is smaller than the passage cross-sectional area of the restricting flow passage F22. The movable member 35 includes a seal portion 36 and an engaging portion 37. The seal portion 36 has a seal surface 36*a* that is configured to cover the restricting flow passage F22. The engaging portion 37 is engaged with the resilient urging member SP2.

A diameter of the engaging portion 37 is smaller than a diameter of the seal portion 36, and a resilient urging member SP2, which is shaped in a form of a coil, is fitted to the engaging portion 37. In this way, movement of the resilient urging member SP2 in the radial direction is limited by the engaging portion 37. One end of the resilient urging member SP2 is supported by a lower end surface of the seal portion 36, and the other end of the resilient urging member SP2 is supported by the coupling member 31. The resilient urging member SP2 is resiliently deformed in the axial direction to apply a resilient force against the movable member 35, and the seal surface 36*a* of the movable member 35 is urged against the lower end surface of the orifice member 32 by the resilient force of the resilient urging member SP2.

The movable core 41 is an annular member made of metal. The movable core 41 includes a movable inside 42 and a movable outside 43, which are respectively shaped into an annular form. The movable inside 42 forms an inner peripheral surface of the movable core 41, and the movable outside 43 is placed on the radially outer side of the movable inside 42. The movable core 41 includes a movable upper surface 41*a* that faces the counter-injection-hole side and is formed at an upper end surface of the movable core 41. A step is formed at the movable upper surface 41*a*. Specifically, the movable outside 43 has a movable outside upper surface 43*a* that faces the counter-injection-hole side, and the movable inside 42 has a movable inside upper surface 42*a* that faces the counter-injection-hole side. The movable outside upper surface 43*a* is placed on the injection-hole side of the movable inside upper surface 42*a*, so that the step is formed at the movable upper surface 41*a*. The movable inside upper surface 42*a* and the movable outside upper surface 43*a* extend perpendicular to the axial direction.

The movable core 41 has a movable lower surface 41*b* that faces the injection-hole side. The movable lower surface 41*b* extends over the movable inside 42 and the movable outside 43 in the radial direction and thereby forms a planar lower end surface of the movable core 41. At the movable lower surface 41*b*, there is no step at a boundary between the movable inside 42 and the movable outside 43. In the axial direction, a height of the movable outside 43 is smaller than a height of the movable inside 42, and thereby the movable core 41 is shaped such that the movable outside 43 projects from the movable inside 42 toward the radially outer side.

The movable core 41 is movable integrally with the coupling member 31, the valve element 30, the orifice member 32 and a slide member 33 in the axial direction. The movable core 41, the coupling member 31, the valve element 30, the orifice member 32 and the slide member 33 collectively serve as a movable structure M that is configured to move integrally in the axial direction.

The slide member 33 is formed separately from the movable core 41 but is fixed to the movable core 41 by, for example, welding. By making the slide member 33 separately from the movable core 41, it is possible to easily realize a structure, in which the slide member 33 and the movable core 41 are made of different materials, respectively. A material of the movable core 41 has a higher degree of magnetism in comparison to a material of the slide member 33, and the material of the slide member 33 has higher wear resistance in comparison to the material of the movable core 41.

The slide member 33 is shaped into a cylindrical tubular form, and a cylindrical outer peripheral surface of the slide member 33 serves as a slide surface 33*a* that is slidable relative to a member at the nozzle body 20 side. A counter-injection-hole side surface of the slide member 33 is joined to an injection-hole-side surface of the movable core 41 by, for example, welding such that the fuel does not pass through a gap between the slide member 33 and the movable core 41. A reduced diameter portion 33*c*, a diameter of which is reduced in the radial direction, is formed at a counter-injection-hole side end portion of the slide member 33. A support member 24 is fixed to the body main portion 21, and a reduced diameter portion 24*a*, a diameter of which is reduced in the radial direction, is formed at the support member 24. The slide member 33 and the support member 24 are arranged one after the other in the axial direction. A separation distance between the slide member 33 and the support member 24 is increased or decreased in response to movement of the movable structure M. This separation distance is minimized in a valve closing state of the valve element 30, in which the valve element 30 closes the injection hole. However, even in this state, the slide member 33 is spaced from the support member 24 toward the counter-injection-hole side.

The movable structure M includes guide portions that enable slide movement of the movable structure M along the nozzle body 20 in the axial direction and support the movable structure M relative to the nozzle body 20 in the radial direction. The guide portions are provided at two axial locations, respectively. One of the guide portions, which is located on the injection hole 23*a* side in the axial direction, is referred to as an injection-hole-side guide portion 30*b* (see FIG. 1), and the other one of the guide portions, which is located on the counter-injection-hole side, is referred to as a counter-injection-hole-side guide portion 31*b*. The injection-hole-side guide portion 30*b* is formed at an outer peripheral surface of the valve element 30 and is slidably supported by an inner peripheral surface of the injection hole member 23. The counter-injection-hole-side guide portion 31*b* is formed at an outer peripheral surface of the coupling member 31 and is slidably supported by an inner peripheral surface of the support member 24.

The stationary cores 50, 51 are fixed in the inside of the case 10. The stationary cores 50, 51 are respectively shaped into a ring form that circumferentially extends about the axis, and the stationary cores 50, 51 are made of metal. The first stationary core 50 is placed on the radially inner side of the coil 70 such that an outer peripheral surface of the first stationary core 50 is opposed to an inner peripheral surface of the coil 70. The first stationary core 50 has a first lower surface 50*a* that faces the injection-hole side, and the first lower surface 50*a* forms a lower end surface of the first stationary core 50 and is perpendicular to the axial direction. The first stationary core 50 is placed on the counter-injection-hole side of the movable core 41, and the first lower surface 50*a* is opposed to the movable inside upper surface 42*a* of the movable core 41. The first stationary core 50 includes a first tilt surface 50*b* and a first outer surface 50*c*. The first tilt surface 50*b* obliquely extends from a radially outer end portion of the first lower surface 50*a* toward the counter-injection-hole side. The first outer surface 50*c* is an outer peripheral surface of the first stationary core 50 and extends from a counter-injection-hole side upper end portion of the first tilt surface 50*b* in the axial direction. The first stationary core 50 is shaped such that an outer corner between the first lower surface 50*a* and the first outer surface 50*c* is chambered to form the first tilt surface 50*b*.

The second stationary core 51 is placed on the injection-hole side of the coil 70 and is shaped into an annular form as a whole. The second stationary core 51 includes a second inside 52 and a second outside 53, which are respectively shaped into an annular form. The second outside 53 forms an outer peripheral surface of the second stationary core 51, and the second inside 52 is placed on the radially inner side of the second outside 53. The second stationary core 51 includes a second lower surface 51*a*, which faces the injection-hole side, and the second lower surface 51*a* forms a lower end surface of the second stationary core 51 and is perpendicular to the axial direction. A step is formed at the second lower surface 51*a*. Specifically, the second inside 52 has a second inside lower surface 52*a* that faces the injection-hole side, and the second outside 53 has a second outside lower surface 53*a* that faces the injection-hole side. The second inside lower surface 52*a* is placed on the counter-injection-hole side of the second outside lower surface 53*a*, so that the step is formed at the second lower surface 51*a*. In the axial direction, a height of the second inside 52 is smaller than a height of the second outside 53, and thereby the second stationary core 51 is shaped such that the second inside 52 projects from the second outside 53 toward the radially inner side.

The second inside 52 of the second stationary core 51 is placed on the counter-injection-hole side of the movable outside 43 of the movable core 41, and the second inside 52 and the movable outside 43 are placed one after the other in the axial direction. In this case, the second inside lower surface 52*a* and the movable outside upper surface 43*a* are opposed to each other in the axial direction.

At the second stationary core 51, the second outside 53 is placed on the counter-injection-hole side of the body main portion 21. The body main portion 21 includes an outside projection 211, which is shaped into an annular form and extends from the radially outer end portion of the body main portion 21 toward the counter-injection-hole side. The outside projection 211 is spaced from a radially inner end portion of the upper end surface of the body main portion 21, so that a step is formed at the upper end surface of the body main portion 21. The body main portion 21 includes a main portion inside upper surface 21*a*, a main portion outside upper surface 21*b*, a main portion outside inner surface 21*c* and a main portion inside inner surface 21*d*. The main portion inside upper surface 21*a* and the main portion outside upper surface 21*b* face the counter-injection-hole side, and the main portion outside inner surface 21*c* and the main portion inside inner surface 21*d* face the radially inner side. The main portion outside upper surface 21*b* is an upper end surface of the outside projection 211, and the main portion outside inner surface 21*c* is an inner peripheral surface of the outside projection 211. The main portion inside inner surface 21*d* extends from a radially inner end portion of the main portion inside upper surface 21*a* toward the injection-hole side and is an inner peripheral surface of the body main portion 21. The main portion inside upper surface 21*a* is a portion of the upper end surface of the body main portion 21, which is located on the radially inner side of the main portion outside inner surface 21*c*. The main portion inside upper surface 21*a* and the main portion outside upper surface 21*b* are perpendicular to the axial direction, and the main portion outside inner surface 21*c* extends in parallel with the axial direction.

At the second stationary core 51, the second outside lower surface 53*a* is overlapped with the main portion outside upper surface 21*b*, and the second stationary core 51 and the body main portion 21 are joined together by, for example, laser welding at this overlapped portion. In a state before the welding, the second outside lower surface 53*a* and the main portion outside upper surface 21*b* are included in a stationary boundary Q, which is a boundary between the second stationary core 51 and the body main portion 21. A width of the second outside lower surface 53*a* and a width of the main portion outside upper surface 21*b*, which are measured in the radial direction, are set to be equal to each other, and the second outside lower surface 53*a* and the main portion outside upper surface 21*b* are entirely overlapped with each other. An outer peripheral surface of the second outside 53 and an outer peripheral surface of the body main portion 21 are overlapped with the inner peripheral surface of the case 10.

The second stationary core 51 includes a second upper surface 51*b* and a second tilt surface 51*c*. The second tilt surface 51*c* obliquely extends from a second inside inner surface 52*b*, which is an inner peripheral surface of the second inside 52, toward the counter-injection-hole side, and the second upper surface 51*b* extends from an upper end portion of the second tilt surface 51*c* in the radial direction. In this case, the second upper surface 51*b* and the second tilt surface 51*c* form an upper end surface of the second stationary core 51. The second tilt surface 51*c* extends along both of the second inside 52 and the second outside 53 in the radial direction. The second stationary core 51 is shaped such that an outer corner between the second upper surface 51*b* and the second inside inner surface 52*b* is chambered to form the second tilt surface 51*c*.

The non-magnetic member 60 is a metal member that is shaped into a ring form and circumferentially extends about the axis, and the non-magnetic member 60 is placed between the first stationary core 50 and the second stationary core 51. A degree of magnetism of the non-magnetic member 60 is lower than a degree of magnetism of each stationary core 50, 51 and the degree of magnetism of the movable core 41 and is made of, for example, a non-magnetic material. Similar to the non-magnetic member 60, a degree of magnetism of the body main portion 21 is lower than the degree of magnetism of each stationary core 50, 51 and the degree of magnetism of the movable core 41, and the body main portion 21 is made of, for example, a non-magnetic material. In contrast, each of the stationary cores 50, 51 and the movable core 41 has the relatively high degree of magnetism and is made of, for example, a ferromagnetic material.

The stationary cores 50, 51 and the movable core 41 may be referred to as magnetic flux passage members, which are likely to be a passage of the magnetic flux, and the non-magnetic member 60 and the body main portion 21 may be referred to as magnetic flux limiting members, which are hard to become a passage of the magnetic flux. Particularly, the non-magnetic member 60 has a function of limiting occurrence of short-circuiting of the magnetic flux between the stationary cores 50, 51 without passing through the movable core 41, and the non-magnetic member 60 may be referred to as a short-circuit limiting member. Furthermore, the non-magnetic member 60 thereby forms a short-circuit liming portion. The body main portion 21 and the nozzle portion 22 are integrally formed in one piece from the metal at the nozzle body 20, so that the body main portion 21 and the nozzle portion 22 have the relatively low degree of magnetism.

The non-magnetic member 60 includes an upper tilt surface 60*a* and a lower tilt surface 60*b*. The upper tilt surface 60*a* is overlapped with a first tilt surface 50*b* of the first stationary core 50, and the upper tilt surface 60*a* and the first tilt surface 50*b* are joined together by welding. The lower tilt surface 60*b* is overlapped with the second tilt surface 51*c* of the second stationary core 51, and the lower tilt surface 60*b* and the second tilt surface 51*c* are joined together by welding. At least a portion of the first tilt surface 50*b* and at least a portion of the second tilt surface 51*c* are arranged one after the other in the axial direction, and the non-magnetic member 60 is interposed between the tilt surfaces 50*b*, 51*c* at least in the axial direction.

A stopper 55, which is shaped into a cylindrical tubular form and is made of metal, is fixed to the inner peripheral surface of the first stationary core 50. The stopper 55 is a member that limits movement of the movable structure M toward the counter-injection-hole side through contact of the stopper 55 against the coupling member 31 of the movable structure M. When a lower end surface of the stopper 55 contacts an upper end surface of the enlarged diameter portion 31*a* of the coupling member 31, the movement of the movable structure M is limited. The stopper 55 projects from the first stationary core 50 toward the injection-hole side. Therefore, even in the state where the movement of the movable structure M is limited by the stopper 55, a predetermined gap is formed between the movable core 41 and each of the stationary cores 50, 51. In this case, the gap is formed between the first lower surface 50*a* and the movable inside upper surface 42*a*, and the other gap is formed between the second inside lower surface 52*a* and the movable outside upper surface 43*a*. In FIG. 3 and the like, for the sake of clear indication of these gaps, a separation distance between the first lower surface 50*a* and the movable inside upper surface 42*a* and a separation distance between the second inside lower surface 52*a* and the movable outside upper surface 43*a* are exaggerated from the real separation distances.

The coil 70 is placed on the radially outer side of the non-magnetic member 60 and the stationary core 50. The coil 70 is wound around a bobbin 71 made of resin. The bobbin 71 is a shaped into a cylindrical tubular form that is cylindrical about the axis. Therefore, the coil 70 is in a ring form that circumferentially extends about the axis. The bobbin 71 contacts the first stationary core 50 and the non-magnetic member 60. A radially-outer-side opening portion, an upper end surface and a lower end surface of the bobbin 71 are covered by a cover 72 made of resin.

A yoke 75 is placed between the cover 72 and the case 10. The yoke 75 is placed on the counter-injection-hole side of the second stationary core 51 and contacts the second upper surface 51*b* of the second stationary core 51. Like the stationary cores 50, 51 and the movable core 41, the yoke 75 has a relatively high degree of magnetism and is made of, for example, a ferromagnetic material. The stationary cores 50, 51 and the movable core 41 form the flow passage of the fuel and are thereby placed at a location where the stationary cores 50, 51 and the movable core 41 contact the fuel. Thus, the stationary cores 50, 51 and the movable core 41 are made to be oil-resistant. In contrast, the yoke 75 does not form the flow passage and is thereby placed at a location where the yoke 75 does not contact the fuel. Therefore, the yoke 75 is not made to be oil-resistant. As a result, the degree of magnetism of the yoke 75 is higher than the degree of magnetism of each stationary core 50, 51 and the degree of magnetism of the movable core 41.

A region of the case 10, which receives the coil 70, is referred to as a coil region. Furthermore, a region of the case 10, which forms the magnetic circuit, is referred to as a magnetic circuit region. In the example shown in FIG. 1, an extent of the magnetic circuit region in an inserting direction (top-to-bottom direction in FIG. 1) is entirely circumferentially surrounded by an inner peripheral surface 4*a* of the installation hole 4. Furthermore, an extent of the coil region in the inserting direction (top-to-bottom direction in FIG. 1) is entirely circumferentially surrounded by the inner peripheral surface 4*a* of the installation hole 4. An outer peripheral surface of the case 10 forms a gap relative to the inner peripheral surface 4*a* of the installation hole 4, and an outer peripheral surface of the magnetic circuit region and the inner peripheral surface 4*a* of the installation hole 4 are opposed to each other while the gap is interposed therebetween. Specifically, the magnetic circuit is surrounded by the cylinder head 3. The cylinder head 3 is an electric conductor. Therefore, when the current is conducted through the coil 70 to cause a magnetic flux change at the magnetic circuit, an eddy current is generated at the cylinder head 3 in response to the change in the magnetic flux.

In the present embodiment, a cover body 90, which covers the stationary boundary Q between the second stationary core 51 and the body main portion 21, is placed on the radially inner side of the second stationary core 51 and the body main portion 21. The cover body 90 is in a ring form and entirely covers the stationary boundary Q in the circumferential direction of the second stationary core 51. The cover body 90 projects from the second stationary core 51 and the body main portion 21 toward the radially inner side in a state where the cover body 90 is placed across the stationary boundary Q in the axial direction. The body main portion 21 includes a main portion cutout N21, and the second stationary core 51 includes a second cutout N51. The cover body 90 is inserted in these cutouts N21, N51.

At the body main portion 21, the main portion cutout N21 is formed by the main portion outside inner surface 21*c* and the main portion inside upper surface 21*a*. The main portion cutout N21 opens toward the injection-hole side in the axial direction and also opens toward the radially inner side. The main portion cutout N21 has a cutout tilt surface N21*a* that connects between the main portion outside inner surface 21*c* and the main portion inside upper surface 21*a*, and the cutout tilt surface N21*a* makes an inner corner of the main portion cutout N21 in a chamfered form.

At the second stationary core 51, the second cutout N51 is formed by the second inside lower surface 52*a* and the second outside inner surface 53*b*. The second outside inner surface 53*b* extends in the axial direction in a state where the second outside inner surface 53*b* faces the radially inner side and thereby forms an inner peripheral surface of the second outside 53. The second cutout N51 is formed by the step of the second lower surface 51*a* of the second stationary core 51 such that the second cutout N51 opens toward the counter-injection-hole side in the axial direction and also opens toward the radially inner side. The second cutout N51 has a cutout tilt surface N51*a* that connects between the second inside lower surface 52*a* and the second outside inner surface 53*b*, and the cutout tilt surface N51*a* makes an inner corner of the second cutout N51 in a chamfered form.

The cover body 90 is placed between the second inside lower surface 52*a* and the main portion inside upper surface 21*a* at the cutouts N21, N51. The main portion outside inner surface 21*c* of the body main portion 21 and the second outside inner surface 53*b* of the second stationary core 51 are flush with each other in the axial direction. A cover outer surface 90*a*, which is an outer peripheral surface of the cover body 90, overlaps with both of the main portion outside inner surface 21*c* and the second outside inner surface 53*b* in a state where the cover outer surface 90*a* covers the stationary boundary Q from the inner side. However, the cover outer surface 90*a* does not overlap with the cutout tilt surfaces N21*a*, N51*a*.

The cover body 90 includes a cover inside 92 and a cover outside 91. The cover outside 91 forms the cover outer surface 90*a*, and the cover inside 92 is placed on the radially inner side of the cover outside 91. A height H1 of the cover inside 92 is smaller than a height H2 of the cover outside 91 (see FIG. 4). The cover body 90 includes a cover upper surface 90*b*, which faces the counter-injection-hole side, and a cover lower surface 90*c*, which faces the injection-hole side. A surface area of the cover upper surface 90*b* is the same as a surface area of the cover lower surface 90*c*.

A counter-injection-hole side upper end surface of the cover inside 92 is placed on the injection-hole side of a counter-injection-hole side upper end surface of the cover outside 91, so that a step is formed at the cover upper surface 90*b*. The cover lower surface 90*c* forms a planar injection-hole-side lower end surface of the cover body 90, and a step is not formed at a boundary between the cover inside 92 and the cover outside 91.

A cover cutout N90 is formed at the cover body 90 by the step formed at the cover upper surface 90*b*. An outer corner of the movable core 41, which is on the injection-hole side and is on the radially outer side, is inserted into the cover cutout N90. In this case, a counter-injection-hole-side end portion of the cover outside 91 is placed between the movable outside 43 and the second outside 53 in the radial direction. Furthermore, the cover inside 92 is placed on the injection-hole side of the second outside 53 in the axial direction.

At the cover body 90, the cover upper surface 90*b* is spaced from the movable lower surface 41*b* of the movable core 41 and the second inside lower surface 52*a* of the second stationary core 51 toward the injection-hole side, and the cover lower surface 90*c* is spaced from the main portion inside upper surface 21*a* of the body main portion 21 toward the counter-injection-hole side. The cover outside 91 is interposed between the second outside 53 and the movable outside 43 in the radial direction, and the cover inside 92 is interposed between the movable core 41 and the main portion inside upper surface 21*a* in the axial direction.

As shown in FIG. 3, a separation distance H1*a*, which is measured between the cover upper surface 90*b* and the second inside lower surface 52*a* in the axial direction, is the same as a separation distance H1*b*, which is measured between the cover lower surface 90*c* and the main portion inside upper surface 21*a* in the axial direction. Furthermore, a separation distance H2*a*, which is measured between the stationary boundary Q and the second inside lower surface 52*a* in the axial direction, is the same as a separation distance H2*b*, which is measured between the stationary boundary Q and the main portion inside upper surface 21*a* in the axial direction. In these cases, the cover outside 91 and the stationary boundary Q are placed at a center position between the second inside lower surface 52*a* and the main portion inside upper surface 21*a* in the axial direction.

In FIGS. 2 and 3, although a separation distance between the cover inside 92 and the movable core 41 in the axial direction is increased or decreased in response to movement of the movable structure M, the cover inside 92 and the movable core 41 do not contact with each other when the valve element 30 is seated against the seatable surface 23*s*. In the present embodiment, a space, which is defined by the cover upper surface 90*b*, the movable core 41 and the second stationary core 51, is referred to as a cover upper chamber S1, and a space, which is defined between the cover lower surface 90*c* and the body main portion 21, is referred to as a cover lower chamber S2. The cover upper chamber S1 and the cover lower chamber S2 are formed by placing the cover body 90 into the main portion cutout N21 and the second cutout N51. The cover upper chamber S1 is included in the flow passage F26*s*, and the cover lower chamber S2 is included in the flow passage F31.

The cover body 90 is formed by a cover member 93 and an opposing member 94. The cover member 93 and the opposing member 94 are annular members made of metal. The opposing member 94 is placed on the radially inner side of the cover member 93. The opposing member 94 is fitted to the inner peripheral surface of the cover member 93, and the opposing member 94 and the cover member 93 are joined together by, for example, welding at a boundary between the opposing member 94 and the cover member 93. The cover member 93 includes an outer peripheral surface side portion, which is included in the cover outside 91, and an inner peripheral surface side portion, which is included in the cover inside 92. In contrast, the opposing member 94 is entirely included in the cover inside 92. The opposing member 94 forms an opposing portion and is supported by the cover member 93.

The opposing member 94 includes an opposing inner surface 94*a* and is placed on the radially outer side of the slide member 33. The opposing inner surface 94*a* is opposed to the slide surface 33*a* of the slide member 33 in the radial direction, and the slide surface 33*a* of the slide member 33 is slidable along the opposing inner surface 94*a*. In this case, the above-described member, which is provided at the nozzle body 20 side and along which the slide surface 33*a* is slidable, is the opposing member 94. The opposing inner surface 94*a* is an inner peripheral surface of the opposing member 94, and a height of the opposing inner surface 94*a*, which is measured in the axial direction, is smaller than a height of the slide surface 33*a*, which is measured in the axial direction. The opposing inner surface 94*a* and the slide surface 33*a* both extend in parallel with the axial direction. A diameter of the slide surface 33*a* is slightly smaller than a diameter of the opposing inner surface 94*a*. Specifically, a position of the slide surface 33*a* in a direction perpendicular to a sliding direction of the slide member 33 is on the radially inner side, i.e., on the center line C side of a radially outermost position of the opposing inner surface 94*a*.

The slide member 33 is slid along the opposing member 94, so that the opposing member 94 also serves as a guide portion that guides the moving direction of the movable structure M. In this case, the opposing inner surface 94*a* may be also referred to as a guiding surface or a guide surface. The opposing member 94 forms a guiding portion.

Like the non-magnetic member 60 and the body main portion 21, a degree of magnetism of the cover member 93 and a degree of magnetism of the opposing member 94 are lower than the degree of magnetism of each stationary core 50, 51 and the degree of magnetism of the movable core 41, and the cover member 93 and the opposing member 94 are made of, for example, a non-magnetic material. Therefore, the cover member 93 and the opposing member 94 are hard to become a passage of the magnetic flux. However, desirably the opposing member 94 is made of a material, which has a high hardness and a high strength, to limit wearing and deformation of the opposing inner surface 94*a* at the time of sliding the slide member 33 along the opposing member 94. In the present embodiment, the high hardness and the high strength of the material of the opposing member 94 are prioritized, and thereby the opposing member 94 is more magnetic than the cover member 93, the non-magnetic member 60 and the body main portion 21. In this case, the opposing member 94 is more likely to be a passage of the magnetic flux in comparison to the cover member 93 or the like. However, the degree of magnetism of the opposing member 94 is lower than the degree of magnetism of each stationary core 50, 51 and the degree of magnetism of the movable core 41, so that the opposing member 94 is less likely to be a passage of the magnetic flux in comparison to the stationary cores 50, 51 or the like.

As discussed above, the stationary boundary Q includes the welded portion, at which the second stationary core 51 and the body main portion 21 are welded together, and this portion will be referred to as a welding portion 96. The welding portion 96 is located in a range that is from an outside end portion of the stationary boundary Q to a predetermined depth in the radial direction. Besides the portion of the second stationary core 51 and the portion of the body main portion 21, the welding portion 96 also includes a portion of the cover body 90. With respect to the cover body 90, a portion of the cover member 93, which forms the cover outside 91 of the cover member 93, is included in the welding portion 96. The depth of the welding portion 96 in the radial direction is larger than a width of the stationary boundary Q by the amount that corresponds to a depth of the portion of the cover member 93 in the radial direction. The welding portion 96 is a solidified portion that is formed such that the portion of the second stationary core 51, the portion of the body main portion 21 and the portion of the cover member 93 are molten and mixed through the heating and are solidified through cooling to form the solidified portion. At the welding portion 96, the three members, i.e., the second stationary core 51, the body main portion 21 and the cover member 93 are joined together.

The welding portion 96 is indicated by halftone dots in FIG. 3, and the stationary boundary Q is indicated an imaginary line in FIG. 3. In contrast, in FIG. 2 and the other drawings, which are other than FIG. 3, the indication the welding portion 96 is omitted for the sake of simplicity. However, in reality, as shown in FIG. 3, the portion of the second stationary core 51, the portion of the body main portion 21, the portion of the cover member 93 and the stationary boundary Q are lost through the formation of the welding portion 96. Therefore, in reality, the cover body 90 covers the welding portion 96 from the radially inner side instead of the stationary boundary Q. However, in the present embodiment, the covering of the welding portion 96 by the cover body 90 and the covering of the stationary boundary Q by the cover body 90 are synonyms to each other.

Referring back to FIG. 1, the pipe connecting portion 80, which forms the flow inlet 80*a* of the fuel and is connected to an external pipe, is placed on the counter-injection-hole side of the first stationary core 50. The pipe connecting portion 80 is made of metal and is formed by a metal member that is formed integrally with the stationary core 50 in one piece. The fuel, which is pressurized by the high pressure pump, is supplied to the fuel injection valve 1 through the flow inlet 80*a*. A flow passage F11 of the fuel, which extends in the axial direction, is formed in an inside of the pipe connecting portion 80, and a press-fitting member 81 is securely press fitted into the flow passage F11.

A resilient member SP1 is placed on the injection-hole side of the press-fitting member 81. The resilient member SP1 is a coil spring that is shaped into a form of a coil and is formed by spirally winding a wire about the center line C. The resilient member SP1 is entirely placed on the side of the movable inside upper surface 42*a*, which is opposite to the injection hole 23*a* in the axial direction. Specifically, a contact surface between the resilient member SP1 and the orifice member 32 is placed on the counter-injection-hole side of the movable inside upper surface 42*a*.

One end of the resilient member SP1 is supported by the press-fitting member 81, and the other end of the resilient member SP1 is supported by the enlarged diameter portion 32*b* of the orifice member 32. Therefore, the amount of resilient deformation of the resilient member SP1 at the valve opening time of the valve element 30, at which the valve element 30 is lifted to a full lift position, i.e., at the time of contacting of the coupling member 31 to the stopper 55, is specified according to the amount of press fitting of the press-fitting member 81, i.e., a fixation position of the press-fitting member 81 in the axial direction. Specifically, a valve closing force, which is a set load of the resilient member SP1, is adjusted by the amount of press fitting of the press-fitting member 81.

A fixation member 83 is placed at an outer peripheral surface of the pipe connecting portion 80. A threaded portion, which is formed at an outer peripheral surface of the fixation member 83, is threadably engaged with a threaded portion, which is formed at an inner peripheral surface of the case 10, so that the fixation member 83 is fixed to the case 10. The pipe connecting portion 80, the stationary cores 50, 51, the non-magnetic member 60 and the body main portion 21 are clamped between a bottom surface of the case 10 and the fixation member 83 by an axial force that is generated by the fixation of the fixation member 83 to the case 10.

The pipe connecting portion 80, the stationary core 50, the non-magnetic member 60, the nozzle body 20 and the injection hole member 23 collectively serve as a body B that has a flow passage F. The flow passage F conducts the fuel received through the flow inlet 80*a* to the injection hole 23*a*. It can be said that the movable structure M described above is slidably received in the inside of the body B.

Next, an operation of the fuel injection valve 1 will be described.

When the coil 70 is energized, a magnetic field is generated around the coil 70. For example, as indicated by a dotted line in FIG. 4, a magnetic circuit, along which the magnetic flux flows, is formed through the stationary cores 50, 51, the movable core 41 and the yoke 75 in response to the energization, so that the movable core 41 is attracted to the stationary cores 50, 51 by a magnetic force generated by the magnetic circuit. In this case, the first lower surface 50*a* and the movable inside upper surface 42*a* become the passage of the magnetic flux, so that the first stationary core 50 and the movable core 41 are attracted to each other. Likewise, the second inside lower surface 52*a* and the movable outside upper surface 43*a* become the passage of the magnetic flux, so that the second stationary core 51 and the movable core 41 are attracted to each other. Therefore, the first lower surface 50*a*, the movable inside upper surface 42*a*, the second inside lower surface 52*a* and the movable outside upper surface 43*a* can be respectively referred to as an attractive surface. Particularly, the movable inside upper surface 42*a* serves as a first attractive surface, and the movable outside upper surface 43*a* serves as a second attractive surface. Furthermore, an attracting direction coincides with the axial direction discussed above. The first attractive surface and the second attractive surface are formed at different locations, respectively, which are different from each other in the moving direction of the movable structure M.

The non-magnetic member 60 does not become the passage of the magnetic flux, so that the magnetic short circuiting between the first stationary core 50 and the second stationary core 51 is limited. An attractive force between the movable core 41 and the first stationary core 50 is generated by a magnetic flux, which passes through the movable inside upper surface 42*a* and the first lower surface 50*a*, and the attractive force between the movable core 41 and the second stationary core 51 is generated by the magnetic flux, which passes through the movable outside upper surface 43*a* and the second lower surface 51*a*. The magnetic flux, which passes through the stationary cores 50, 51 and the movable core 41, includes the magnetic flux, which passes through not only the yoke 75 but also the case 10.

Furthermore, since the degree of magnetism of the body main portion 21 and the degree of magnetism of the cover body 90 are lower than the degree of magnetism of each stationary core 50, 51, the flow of the magnetic flux through the body main portion 21 and the cover body 90 is limited. As described above, the high hardness and the high strength of the opposing member 94 are prioritized to withstand the sliding of the slide member 33 along the opposing member 94, and thereby the opposing member 94 becomes more magnetic. However, since the degree of magnetism of the cover member 93 is sufficiently low, the cover member 93 limits the magnetic flux from passing through the second stationary core 51 to reach the opposing member 94.

In addition to the attractive force generated by the magnetic flux described above, the valve closing force, which is exerted by the resilient member SP1, the valve closing force, which is exerted by the fuel pressure, and the valve opening force, which is exerted by the magnetic force described above, are applied to the movable structure M. The valve opening force is set to be larger than these valve closing forces. Therefore, when the magnetic force is generated in response to the energization, the movable core 41 is moved together with the valve element 30 toward the counter-injection-hole side. In this way, the valve element 30 makes the valve opening movement, so that the seat surface 30*s* is lifted away from the seatable surface 23*s*, and thereby the high pressure fuel is injected from the injection hole 23*a*.

When the energization of the coil 70 is stopped, the valve opening force, which is generated by the magnetic force described above, is lost. Therefore, the valve element 30 makes the valve closing movement together with the movable core 41 by the valve closing force of the resilient member SP1, so that the seat surface 30*s* is seated against the seatable surface 23*s*. In this way, the valve element 30 makes the valve closing movement, and thereby the fuel injection from the injection hole 23*a* is stopped.

Next, the flow of the fuel at the time of injecting the fuel from the injection hole 23*a* will be described with reference to FIGS. 1 and 2.

The high pressure fuel, which is supplied from the high pressure pump to the fuel injection valve 1, is inputted into the flow inlet 80*a* and flows through the flow passage F11, which is along the cylindrical inner peripheral surface of the pipe connecting portion 80, the flow passage F12, which is along the cylindrical inner peripheral surface of the press-fitting member 81, and the flow passage F13, in which the resilient member SP1 is received (see FIG. 1). These flow passages F11, F12, F13 are collectively referred to as an upstream flow passage F10. In the flow passage F formed in the inside of the fuel injection valve 1, the upstream flow passage F10 is located at the outside of the movable structure M and is on the upstream side of the movable structure M. Furthermore, in the flow passage F, a flow passage, which is formed by the movable structure M, will be referred to as a movable flow passage F20, and a flow passage, which is located on the downstream of the movable flow passage F20, will be referred to as a downstream flow passage F30.

The movable flow passage F20 conducts the fuel outputted from the flow passage F13 to a main passage and a sub-passage. The main passage and the sub-passage are independently arranged. Specifically, the main passage and the sub-passage are arranged in parallel, and the fuel, which flows through the main passage, and the fuel, which flows in the sub-passage, are merged at the downstream flow passage F30.

The main passage is a passage that conducts the fuel through the flow passage F21, which is along the cylindrical inner peripheral surface of the orifice member 32, the restricting flow passage F22, which is defined by the orifice 32*a*, and the flow passage F23, which is along the cylindrical inner peripheral surface of the coupling member 31, in this order. Thereafter, the fuel of the flow passage F23 flows via through-holes, which radially extend through the coupling member 31, and then the fuel flows into the flow passage F31 of the downstream flow passage F30, which is along the cylindrical outer peripheral surface of the coupling member 31. The downstream flow passage F30 includes a cover lower chamber S2 located on the injection-hole side of the cover body 90, and the cover lower chamber S2 is communicated with a gap between the support member 24 and the slide member 33.

The sub-passage is a passage that conducts the fuel through a flow passage F24*s*, which is along the cylindrical outer peripheral surface of the orifice member 32, a flow passage F25*s*, which is a gap between the movable core 41 and the stationary core 50, a flow passage F26*s*, which extends on the radially outer side of the movable core 41, and a slide flow passage F27*s*, which is along the slide surface 33*a*, in this order. The flow passage F26*s* includes a cover upper chamber S1, which is placed on the counter-injection-hole side of the cover body 90. The flow passage F26*s* includes an interspace defined by the movable core 41 relative to the first stationary core 50, the non-magnetic member 60, the second stationary core 51 and the cover body 90. In the flow passage F26*s*, an interspace between the first lower surface 50*a* and the movable inside upper surface 42*a* and an interspace between the second inside lower surface 52*a* and the movable outside upper surface 43*a* are also included in the gap between the movable core 41 and the stationary core 50. The sub-passage is defined between the body main portion 21 and the movable structure M, and the body main portion 21 serves as a passage forming portion, which forms the sub-passage.

The slide flow passage F27*s* may be referred to as a separate flow passage, and the fuel of the slide flow passage F27*s* flows into the flow passage F31 of the downstream flow passage F30, which is along the cylindrical outer peripheral surface of the coupling member 31. A passage cross-sectional area of the slide flow passage F27*s* is smaller than a passage cross-sectional area of the flow passage F26*s*, which extends on the radially outer side of the movable core 41. Specifically, a degree of flow restriction of the slide flow passage F27*s* is set to be larger than a degree of flow restriction of the flow passage F26*s*.

Here, an upstream portion of the sub-passage is connected to a portion that is on the upstream side of the restricting flow passage F22. A downstream portion of the sub-passage is connected to a downstream portion of the restricting flow passage F22. Specifically, the sub-passage connects between the upstream portion of the restricting flow passage F22 and the downstream portion of the restricting flow passage F22 while the sub-passage bypasses the restricting flow passage F22.

The fuel, which flows from the flow passage F13 of the upstream flow passage F10 into the movable flow passage F20, is branched into the flow passage F21, which forms an upstream end of the main passage, and a flow passage F24*s*, which forms an upstream end of the sub-passage, and the branched flows of the fuel are thereafter merged at the flow passage F31 that is the downstream passage F30.

Through-holes 45 are formed such that each through-hole 45 extends through the movable core 41, the coupling member 31 and the orifice member 32 in the radial direction. The through-holes 45 serve as a flow passage F28*s* that communicates between the flow passage F21, which is along the inner peripheral surface of the orifice member 32, and the flow passage F26*s*, which is along the outer peripheral surface of the movable core 41. The flow passage F28*s* is a passage that ensures a required flow rate of the fuel, which flows in the slide flow passage F27*s*, i.e., a required flow rate of the sub-passage in a case where the communication between the flow passage F24*s* and the flow passage F25*s* is blocked through contact of the coupling member 31 to the stopper 55. The flow passage F28*s* is placed on the upstream side of the restricting flow passage F22, so that the flow passages F25*s*, F26*s*, F28*s* form an upstream region, and a pressure difference is generated between the upstream region and a downstream region.

The fuel, which is outputted from the movable flow passage F20, flows into the flow passage F31, which is along the cylindrical outer peripheral surface of the coupling member 31, and then the fuel flows through a flow passage F32, which is a through-hole extending through the reduced diameter portion 24*a* of the support member 24 in the axial direction, and a flow passage F33, which is along the outer peripheral surface of the valve element 30 (see FIG. 2). When the valve element 30 makes the valve opening movement, the high pressure fuel in the flow passage F33 passes through the gap between the seat surface 30*s* and the seatable surface 23*s* and is injected from the injection hole 23*a*.

The flow passage, which is along the slide surface 33*a*, is referred to as the slide flow passage F27*s*. A passage cross-sectional area of the slide flow passage F27*s* is smaller than a passage cross-sectional area of the restricting flow passage F22. Specifically, a degree of flow restriction at the slide flow passage F27*s* is set to be larger than a degree of flow restriction at the restricting flow passage F22. The passage cross-sectional area of the restricting flow passage F22 is the smallest in the main passage, and the passage cross-sectional area of the slide flow passage F27*s* is the smallest in the sub-passage.

Therefore, among the main passage and the sub-passage in the movable flow passage F20, the fuel can more easily flow in the main passage. The degree of flow restriction of the main passage is specified by the degree of flow restriction at the orifice 32*a*, and the flow rate of the main passage is adjusted by the orifice 32*a*. In other words, the degree of flow restriction of the movable flow passage F20 is specified by the degree of flow restriction at the orifice 32*a*, and the flow rate of the movable flow passage F20 is adjusted by the orifice 32*a*.

A passage cross-sectional area of the flow passage F at the seat surface 30*s* in the full lift state, in which the valve element 30 has moved farthest in the valve opening direction, is referred to as a seat passage cross-sectional area. The passage cross-sectional area of the restricting flow passage F22 defined by the orifice 32*a* is set to be larger than the seat passage cross-sectional area. Specifically, the degree of flow restriction by the orifice 32*a* is set to be smaller than the degree of flow restriction at the seat surface 30*s* at the full lift time.

The seat passage cross-sectional area is set to be larger than the passage cross-sectional area of the injection hole 23*a*. Specifically, the degree of flow restriction by the orifice 32*a* and the degree of flow restriction at the seat surface 30*s* are set to be smaller than the degree of flow restriction at the injection hole 23*a*. In a case where a plurality of injection holes 23*a* is formed, the seat passage cross-sectional area is set to be larger than a sum of passage cross-sectional areas of all of the injection holes 23*a*.

Now, the movable member 35 will be described. When the fuel pressure on the upstream side of the movable member 35 becomes larger than the fuel pressure on the downstream side of the movable member 35 by a predetermined amount or larger in response to the movement of the valve element 30 in the valve opening direction, the movable member 35 is lifted away from the orifice member 32 against the resilient force of the resilient urging member SP2. When the fuel pressure on the downstream side of the movable member 35 becomes larger than the fuel pressure on the upstream side of the movable member 35 by a predetermined amount or larger in response to the movement of the valve element 30 in the valve closing direction, the movable member 35 is seated against the orifice member 32.

In the state where the movable member 35 is lifted away from the orifice member 32, a flow passage, which conducts the fuel, is generated between the outer peripheral surface of the movable member 35 and the inner peripheral surface of the coupling member 31. An outer-peripheral-side flow passage F23*a* and the sub-restricting passage 38 are arranged in parallel. In the state where the movable member 35 is lifted away from the orifice member 32, the fuel to be outputted from the restricting flow passage F22 to the flow passage F23, is branched into the sub-restricting passage 38 and the outer-peripheral-side flow passage F23*a*. A sum of the passage cross-sectional area of the sub-restricting passage 38 and the passage cross-sectional area of the outer-peripheral-side flow passage F23*a* is larger than the passage cross-sectional area of the restricting flow passage F22. Therefore, in the state where the movable member 35 is lifted away from the orifice member 32, the flow rate of the movable flow passage F20 is specified by the degree of flow restriction at the restricting flow passage F22.

In contrast, in the state where the movable member 35 is seated against the orifice member 32, the fuel to be outputted from the restricting flow passage F22 into the flow passage F23 flows in the sub-restricting passage 38 but does not flow in the outer-peripheral-side flow passage F23*a*. A passage cross-sectional area of the sub-restricting passage 38 is smaller than the passage cross-sectional area of the restricting flow passage F22. Therefore, in the state where the movable member 35 is seated against the orifice member 32, the flow rate of the movable flow passage F20 is specified by the degree of flow restriction at the sub-restricting passage 38. Thus, the movable member 35 increases the degree of flow restriction by covering the restricting flow passage F22 upon seating of the movable member 35 against the orifice member 32 and decreases the degree of flow restriction by opening the restricting flow passage F22 upon lifting of the movable member 35 from the orifice member 32.

In the state where the valve element 30 is in the middle of moving in the valve opening direction, there is a high probability of that the fuel pressure on the upstream side of the movable member 35 becomes larger than the fuel pressure on the downstream side of the movable member 35 by the predetermined amount or larger, and thereby the movable member 35 is lifted away from the orifice member 32. However, in a state where the valve element 30 is held in the full lift state, in which the valve element 30 has moved farthest in the valve opening direction, there is a high possibility of that the movable member 35 is seated against the orifice member 32.

In the state where the valve element 30 is in the middle of moving in the valve closing direction, there is a high possibility of that the fuel pressure on the downstream side of the movable member 35 becomes larger than the fuel pressure on the upstream side of the movable member 35 by the predetermined amount or larger, and thereby the movable member 35 is seated against the orifice member 32. However, in a case where the valve opening period is shortened to reduce the injection amount of fuel injected from the injection hole 23*a*, the valve element 30 does not move to the full lift position, and thereby valve opening movement is switched to the valve closing movement to execute a partial lift injection. In this case, immediately after the switching from the valve opening movement to the valve closing movement, there is a high possibility of that the movable member 35 is lifted away from the orifice member 32. However, in a time period immediately before the valve closing, there is a high possibility of that the fuel pressure on the downstream side of the movable member 35 becomes larger that the fuel pressure on the upstream side of the movable member 35 by the predetermined amount or larger, and thereby the movable member 35 is seated against the orifice member 32.

In short, the movable member 35 is not necessarily always opened during the middle of the valve opening movement of the valve element 30, and the movable member 35 is seated against the orifice member 32 in at least the time period immediately after the valve opening in the pressure increasing period, in which the valve element 30 is moved in the valve opening direction. Furthermore, the movable member 35 is not necessarily always seated against the orifice member 32 during the middle of the valve closing movement of the valve element 30, and the movable member 35 is seated against the orifice member 32 in at least the time period immediately before the valve closing in the pressure decreasing period, in which the valve element 30 is moved in the valve closing direction. Therefore, in the time period immediately after the valve opening and the time period immediately before the valve closing, the movable member 35 is seated against the orifice member 32, and thereby all of the fuel passes through sub-restricting passage 38. Thus, in comparison to the time period, in which the movable member 35 is lifted away from the orifice member 32, the degree of flow restriction at the movable flow passage F20 is increased.

Figure 4:
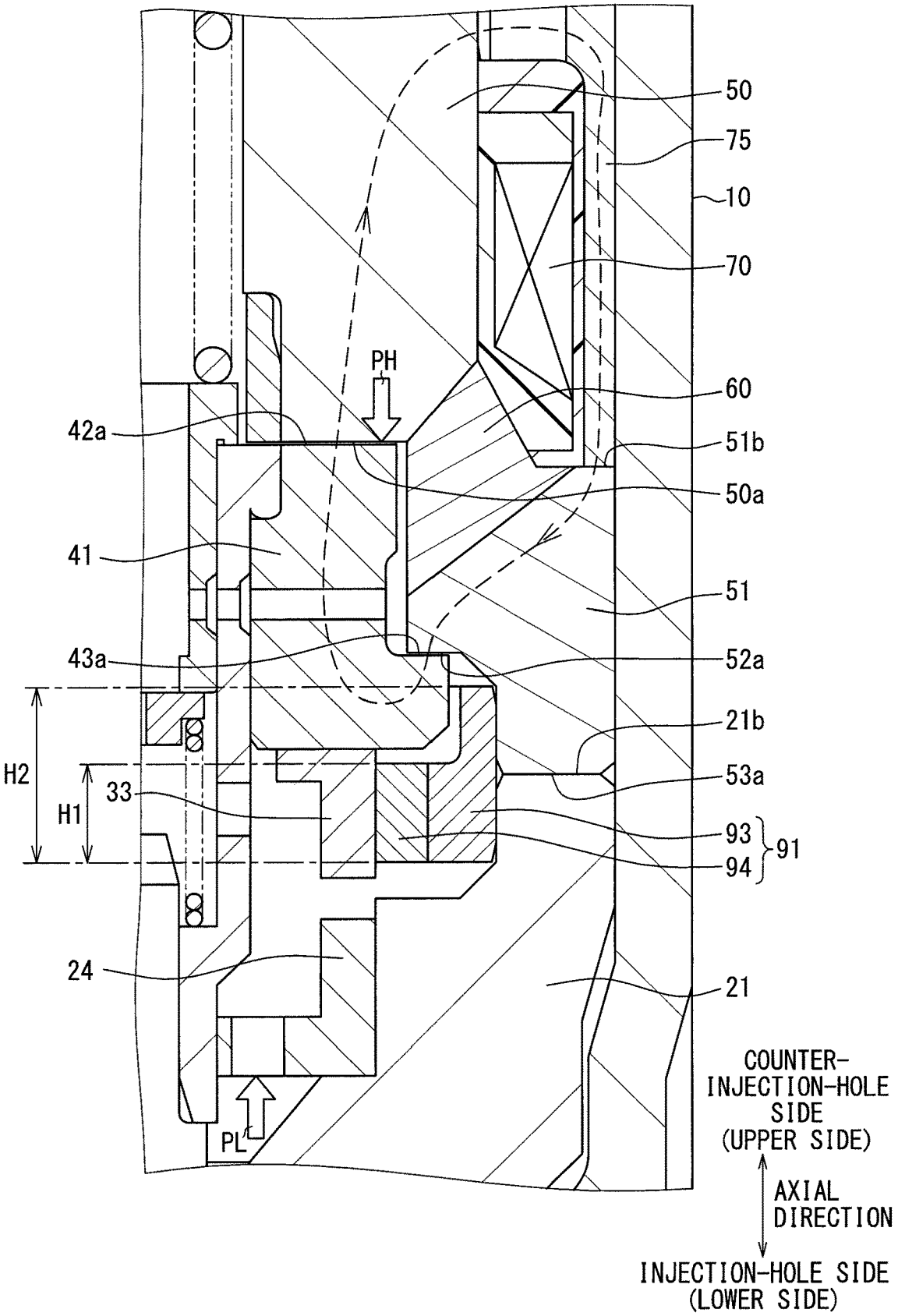
FIG. 4 is a diagram for describing a passage of a magnetic flux.
Figure 5:
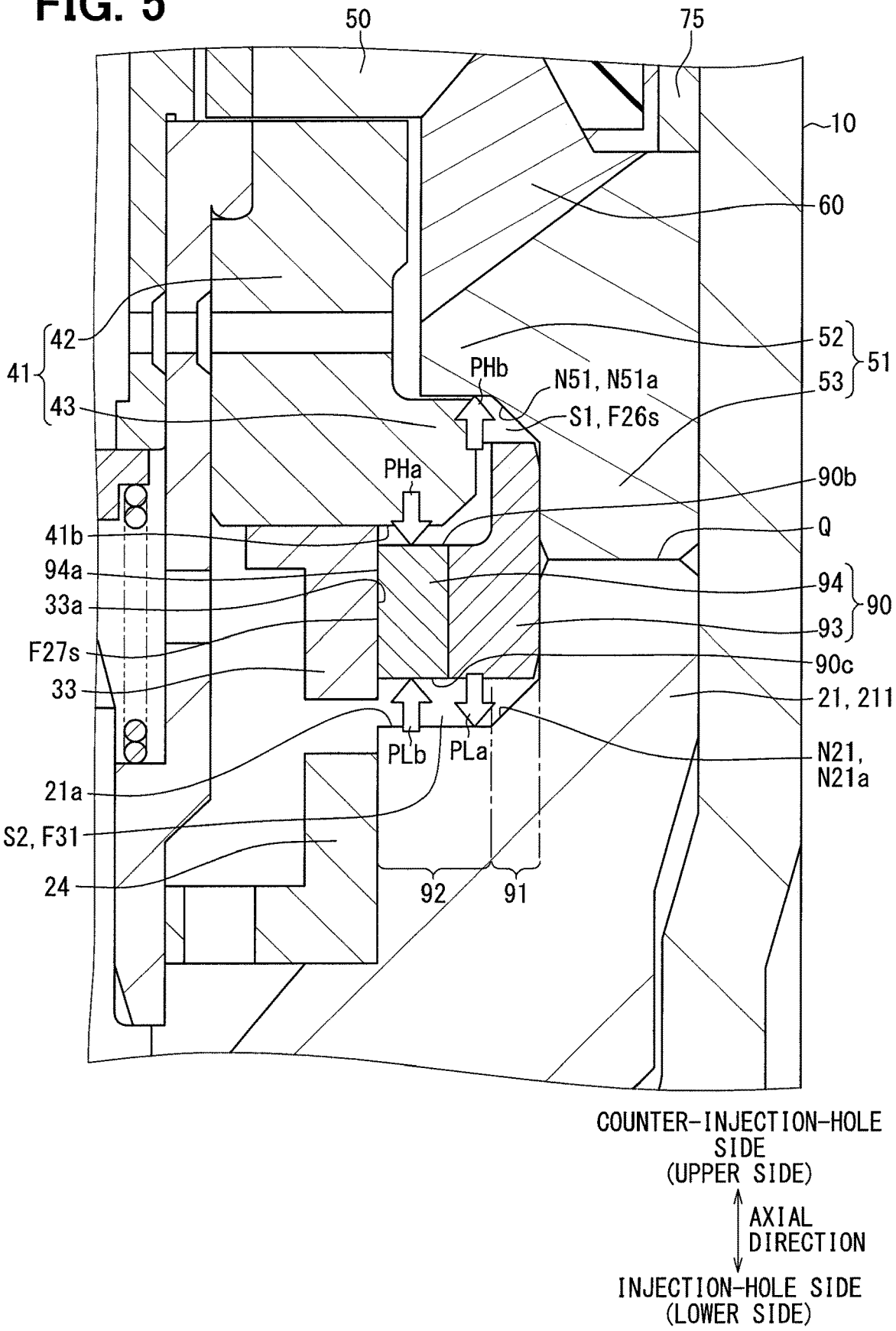
FIG. 5 is a diagram for describing a relationship between the cover body and a fuel pressure.

Next, pressures, which are generated at the time of moving the movable structure M, will be described with reference to FIGS. 4 and 5.

In the present embodiment, the restricting flow passage F22 and the slide flow passage F27*s* are arranged in parallel, and the passage cross-sectional area of the slide flow passage F27*s* is set to be smaller than the passage cross-sectional area of the restricting flow passage F22. Therefore, the flow passage F is divided into the upstream region and the downstream region while the orifice 32*a* and the slide flow passage F27*s* form a boundary between the upstream region and the downstream region.

The upstream region is a region, which is located on the upstream side of the orifice 32*a* in the fuel flow at the fuel injection time. A portion of the movable flow passage F20, which is located on the upstream side of the slide surface 33*a*, also belongs to the upstream region. Therefore, the flow passages F21, F24*s*, F25*s*, F26*s*, F28*s* and the upstream flow passage F10 in the movable flow passage F20 belong to the upstream region. The downstream region is a region, which is located on the downstream side of the orifice 32*a* in the fuel flow at the fuel injection time. A portion of the movable flow passage F20, which is located on the downstream side of the slide surface 33*a*, also belongs to the downstream region. Therefore, the flow passage F23 and the downstream flow passage F30 in the movable flow passage F20 belong to the downstream region.

Specifically, when the fuel flows in the restricting flow passage F22, the flow rate of the fuel, which flows in the movable flow passage F20, is restricted by the orifice 32*a*. Therefore, a pressure difference is generated between an upstream fuel pressure PH, which is a fuel pressure of the upstream region, and a downstream fuel pressure PL, which is a fuel pressure of the downstream region (see FIG. 4). At the time of shifting the valve element 30 from the valve closing state to the valve opening state, the time of shifting the valve element 30 from the valve opening state to the valve closing state, and the time of holding the valve element 30 at the full lift position, the fuel flows in the restricting flow passage F22, and thereby the above-described pressure difference is generated.

The above-described pressure difference, which is generated by the valve opening operation of the valve element 30, is not lost simultaneously with the switching from the valve opening to the valve closing. Rather, the upstream fuel pressure PH and the downstream fuel pressure PL become equal to each other when a predetermined time period elapses from the time of valve closing. In contrast, when the operation is switched from the valve closing to the valve opening in the state where the above-described pressure difference is not generated, the above-described pressure difference is immediately generated at the timing of switching from the valve closing to the valve opening.

During the movement of the movable structure M in the valve opening direction, the fuel of the upstream region is urged and is compressed by the movable structure M, so that the upstream fuel pressure PH is increased. In contrast, the fuel of the upstream region, which is urged by the movable structure M, is restricted by the orifice 32*a* and is pushed into the downstream region, so that the downstream fuel pressure PL becomes lower than the upstream fuel pressure PH. At the time of the valve opening movement, the fuel flows in the restricting flow passage F22 toward the injection-hole side.

During the movement of the movable structure M in the valve closing direction, the fuel of the downstream region is urged and is compressed by the movable structure M, so that the downstream fuel pressure PL is increased. In contrast, the fuel of the downstream region, which is urged by the movable structure M, is restricted by the orifice 32*a* and is pushed into the upstream region, so that the upstream fuel pressure PH becomes lower than the downstream fuel pressure PL. At the time of valve closing movement, the fuel flows in the restricting flow passage F22 toward the counter-injection-hole side.

Now, a relationship between the cover body 90 and the fuel pressure will be described with reference to FIG. 5. At the cover upper chamber S1, which is located on the counter-injection-hole side of the cover body 90, the upper chamber downward fuel pressure PHa and the upper chamber upward fuel pressure PHb, which correspond to the upstream fuel pressure PH, are generated due to the fact of that the cover upper chamber S1 is included in the upstream region. The upper chamber downward fuel pressure PHa is a pressure, which urges the cover body 90 toward the injection-hole side, and the upper chamber downward fuel pressure PHa is applied to both of the cover outside 91 and the cover inside 92. For example, the cover upper surface 90*b* is downwardly urged. In contrast, the upper chamber upward fuel pressure PHb is a pressure, which urges the second stationary core 51 toward the counter-injection-hole side, and the upper chamber upward fuel pressure PHb is applied to the second inside 52. For example, the second inside lower surface 52*a* is upwardly urged.

At the cover lower chamber S2, which is located on the injection-hole side of the cover body 90, since the cover lower chamber S2 is included in the downstream region, a lower chamber downward fuel pressure PLa and a lower chamber upward fuel pressure PLb, which correspond to the downstream fuel pressure PL, are generated. The lower chamber upward fuel pressure PLb is a pressure, which upwardly urges the cover body 90 toward the counter-injection-hole side, and the lower chamber upward fuel pressure PLb is applied to both of the cover outside 91 and the cover inside 92 in the cover lower chamber S2. For example, the cover lower surface 90*c* is upwardly urged. In contrast, the lower chamber downward fuel pressure PLa is a pressure that downwardly urges the body main portion 21 toward the injection-hole side. For example, the main portion inside upper surface 21*a* is downwardly urged.

As discussed above, in the state where the fuel pressures PHa, PHb are generated on the counter-injection-hole side of the cover body 90, and the fuel pressures PLa, PLb are generated on the injection-hole side of the cover body 90, the upper chamber downward fuel pressure PHa and the lower chamber upward fuel pressure PLb counteract with each other through the cover body 90. Similarly, the upper chamber upward fuel pressure PHb and the lower chamber downward fuel pressure PLa counteract with each other through the second stationary core 51 and the body main portion 21. Therefore, there is limited the application of the pressures in the directions for moving the second stationary core 51 and the body main portion 21 away from each other in the up-to-down direction in the cover upper chamber S1 and the cover lower chamber S2.

For example, in a structure, in which the cover upper chamber S1 is formed while the cover lower chamber S2 is not formed unlike the present embodiment, the pressure, which counteracts against the upper chamber downward fuel pressure PHa, is not applied to the cover body 90, and the pressure, which counteracts against the upper chamber upward fuel pressure PHb, is not applied to the body main portion 21. Therefore, the upper chamber downward fuel pressure PHa downwardly urges the body main portion 21 together with the cover body 90 toward the injection-hole side, and the upper chamber upward fuel pressure PHb upwardly urges the second stationary core 51 toward the counter-injection-hole side. In this case, the fuel pressures PHa, PHb are exerted to move the second stationary core 51 and the body main portion 21 away from each other. Therefore, this is not preferable in view of properly maintaining the joint state between the second stationary core 51 and the body main portion 21 at the stationary boundary Q. In contrast, according to the present embodiment, as discussed above, the fuel pressures PHa, PHb in the cover upper chamber S1 and the fuel pressures PLa, PLb in the cover lower chamber S2 counteract with each other, so that this is preferable in view of properly maintaining the joint state between the second stationary core 51 and the body main portion 21 at the stationary boundary Q.

Next, the function of the cover upper chamber S1 will be described. As discussed above, in the middle of moving the movable structure M in the valve closing direction, the fuel flows from the flow passage F31 (e.g., the cover lower chamber S2) to the cover upper chamber S1 through the restricting flow passage F22. In this case, at the flow passage F26*s*, due to the presence of the flow passages F24*s*, F25*s* on the upstream side of the cover upper chamber S1, it is difficult for the fuel to flow from the cover upper chamber S1 to the main passage (e.g., the flow passage F21) and the upstream flow passage F10 (e.g., the flow passage F13). In other words, in order to create the flow of the fuel out of the cover upper chamber S1 toward the main passage and the upstream flow passage F10, the movable lower surface 41*b* of the movable core 41 needs to be moved toward the cover upper surface 90*b* of the cover body 90 in the axial direction against the valve closing force of the resilient member SP1. At the time of moving the movable structure M in the valve closing direction, the cover upper chamber S1 implements a damper function and thereby exerts a brake force against the movable structure M. Therefore, the bouncing of the valve element 30 at the seatable surface 23*s* is limited at the valve closing time, and thereby an unintended fuel injection is limited.

Hereinafter, a manufacturing method of the fuel injection valve 1 will be described. Here, an assembling procedure after manufacturing of the components will be mainly described.

First of all, the support member 24 is installed to the body main portion 21 of the nozzle body 20. Here, the support member 24 is inserted into the inside of the body main portion 21, and the body main portion 21 and the support member 24 are fixed together by, for example, welding.

Next, the cover body 90 is installed to the body main portion 21. Here, the opposing member 94 is inserted into the inside of the cover member 93, and the cover member 93 and the opposing member 94 are fixed together by, for example, welding. Thereby, the cover body 90 is produced in advance. Then, the cover body 90 is inserted into the inside of the body main portion 21. In this case, an axial length of the inserted portion of the cover body 90, which is inserted into the inside of the body main portion 21, and an axial length of the projecting portion of the cover body 90, which projects from the body main portion 21, are set to be substantially equal to each other. The length of the inserted portion of the cover body 90 corresponds to the separation distance H2*b*, and the length of the projecting portion of the cover body 90 corresponds to the separation distance H2*a*.

Thereafter, the movable structure M is installed to the nozzle body 20. The movable structure M is manufactured in advance by assembling the movable core 41, the coupling member 31, the valve element 30, the orifice member 32, the slide member 33, the movable member 35 and the resilient urging member SP2 together. Here, the movable structure M is installed to the nozzle body 20 by inserting the valve element 30 into the inside of the nozzle portion 22 and inserting the slide member 33 into the inside of the cover body 90.

Next, the stationary cores 50, 51 and the non-magnetic member 60 are installed to the nozzle body 20. Here, a core unit is manufactured in advance by installing the stationary cores 50, 51 to the non-magnetic member 60 and fixing the non-magnetic member 60 and the stationary cores 50, 51 together by, for example, welding. Then, the second stationary core 51 is installed to the body main portion 21 and the cover body 90 by installing the core unit to the nozzle body 20. In this case, the end portion of the cover body 90 is inserted into the inside of the second stationary core 51, and the second lower surface 51*a* of the second stationary core 51 is overlapped with the main portion outside upper surface 21*b* of the body main portion 21. In this way, the stationary boundary Q is present between the second stationary core 51 and the body main portion 21.

Thereafter, a welding operation is performed all around the stationary boundary Q from the radially outer side of the stationary boundary Q through use of a welding tool, so that the welding portion 96 is formed. In this case, spatter particles, such as slag, metal particles or the like, which are generated at the time of welding, may possibly be scattered into the inside space of the second stationary core 51 and the body main portion 21 through the stationary boundary Q. With respect to this point, the cover body 90 covers the stationary boundary Q from the radially inner side, so that even if the spatter particles are generated by the welding, the spatter particles collide against the cover body 90 and will not fly further toward the radially inner side. Therefore, scattering of the spatter particles beyond the stationary boundary Q toward the radially inner side is limited by the cover body 90.

The welding is performed such that the welding portion 96 reaches the cover body 90 beyond the stationary boundary Q. Here, a test is conducted to know a required heating temperature and a required heating time period, which are required to extend the welding portion 96 to the cover body 90 beyond the stationary boundary Q at the time of applying the heat for the welding. Then, a heating temperature and a heating time period at the time of welding are set based on this test result. In this way, it is possible to limit occurrence of a state where the welding portion 96 does not reach the cover body 90.

Once the welding portion 96 is formed, the coil 70 and the yoke 75 are installed to the first stationary core 50. Then, these components are received into the case 10, so that the manufacturing of the fuel injection valve 1 is completed.

Next, a detailed structure of the above-described fuel injection valve 1 will be discussed.

The movable core 41 is a portion of the movable structure M that includes the movable inside upper surface 42*a* (the first attractive surface) and the movable outside upper surface 43*a* (the second attractive surface). A long portion of the movable structure M, which is longer than the movable core 41 in the axial direction, will be referred to as an elongated shaft member. In the present embodiment, the valve element 30 and the coupling member 31 collectively serve as the elongated shaft member. A material of the movable core 41 and a material of the elongated shaft member are different from each other.

Specifically, a modulus of longitudinal elasticity of the elongated shaft member is larger than a modulus of longitudinal elasticity of the movable core 41. Furthermore, a hardness of the elongated shaft member is higher than a hardness of the movable core 41. A specific gravity of the elongated shaft member is smaller than a specific gravity of the movable core 41. The movable core 41 has the degree of magnetism that is higher than the degree of magnetism of the elongated shaft member, so that a magnetic flux can more easily pass through the movable core 41 in comparison to the elongated shaft member. The elongated shaft member has stronger abrasion resistance than the movable core 41 and is less prone to wear.

The above difference in the modulus of longitudinal elasticity can be confirmed by a tensile test. There is performed a tensile test on each of, for example, the movable core 41, the valve element 30 and the coupling member 31 to break it by applying a tensile load, and a slope of a linear part (elastic region) of a stress-strain curve obtained through the process of the breaking indicates the modulus of longitudinal elasticity. In the above tensile test, each of the movable core 41, the valve element 30 and the coupling member 31 may be cut through a cutting process to a predetermined sample shape, and a tensile load may be applied to this sample product. Alternatively, without executing the cutting process discussed above, the tensile load may be directly applied to each of the movable core 41, the valve element 30 and the coupling member 31. Furthermore, the modulus of longitudinal elasticity is measured through the tensile test for a predetermined number n of sample products. In a case where an average value of the measured moduli of longitudinal elasticity of these sample products is indicated by $\mu$ while a standard deviation is indicated by $\sigma$, all of the moduli of longitudinal elasticity, which fall in a range of $\mu \pm \sigma$ among the predetermined number n of the sample products, indicate the following result. Specifically, the modulus of longitudinal elasticity of the elongated shaft member is larger than the modulus of longitudinal elasticity of the movable core 41.

Next, effects and advantages of the structure used in this embodiment will be described.

The movable core 41 is shaped into a stepped form that includes the movable inside upper surface 42*a* (the first attractive surface) and the movable outside upper surface 43*a* (the second attractive surface), which are respectively formed at the different locations that are different from each other in the axial direction. An inflow direction of the magnetic flux into the first attractive surface and an inflow direction of the magnetic flux into the second attractive surface are different from each other. In this way, the magnetic attractive force can be increased in comparison to a case where a movable core has two attractive surfaces, which are axially located at the same position unlike the present embodiment, and a flow direction of the magnetic flux differs between these two attractive surfaces. A reason for this will be described with reference to FIGS. 6 and 7.

Figure 6:
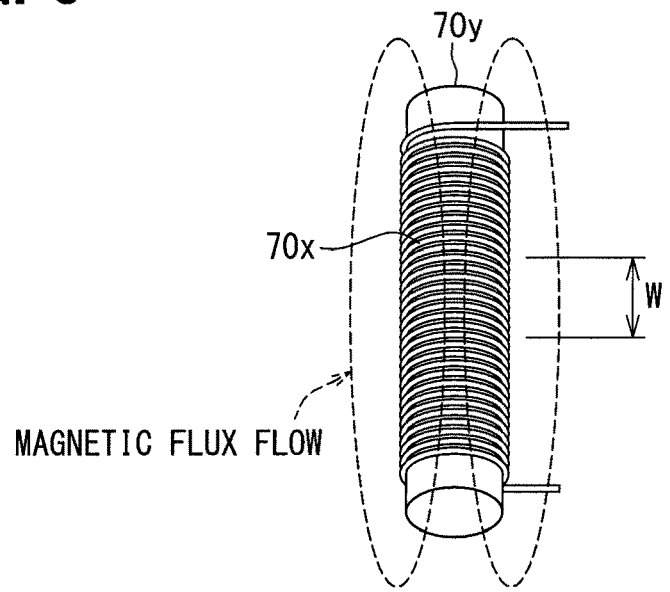
FIG. 6 is a plan view indicating a distribution of a magnetic flux with respect to a coil of a test piece.
Figure 7:
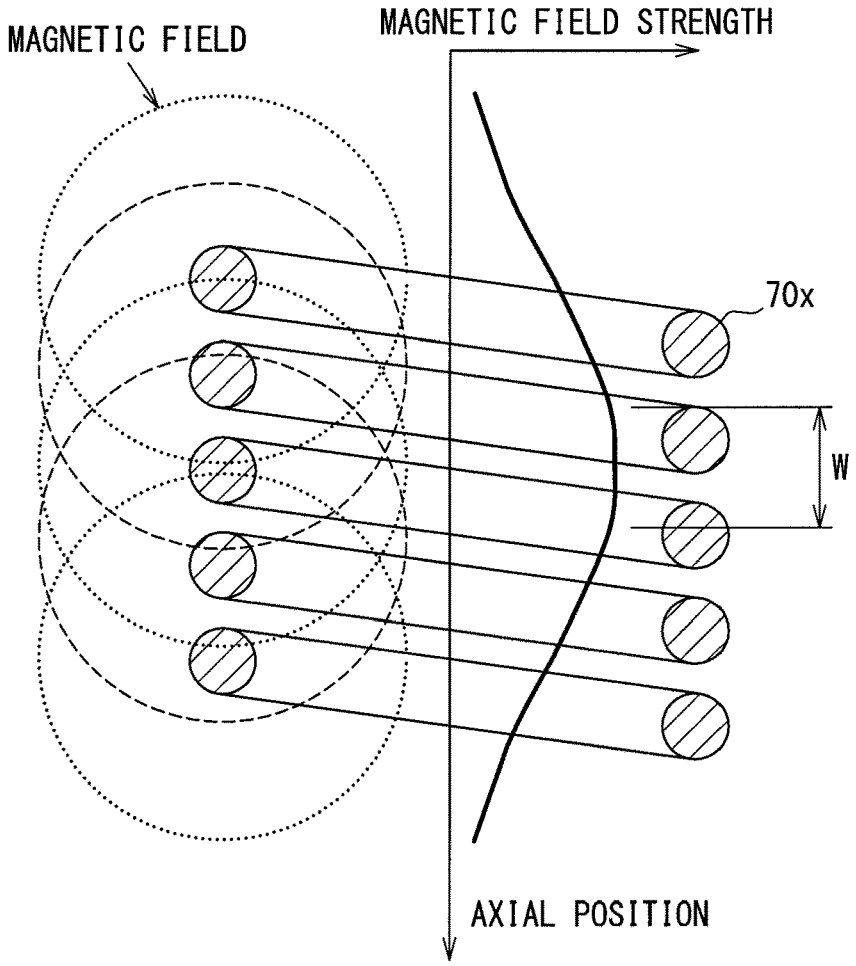
FIG. 7 is a cross-sectional view showing a distribution of a magnetic field strength with respect to the coil shown in FIG. 6.

FIGS. 6 and 7 show a test sample that is formed by winding a coil main body 70*x* around an iron core 70*y*. When the current is conducted through the coil main body 70*x*, a distribution of a magnetic flux, which is indicated by dotted lines in FIG. 6, is generated to form a distribution of magnetic fields indicated by dotted lines in FIG. 7. At a center portion W of the iron core 70*y*, which is centered in the axial direction, the number of overlapping magnetic fields is large, as indicated in FIG. 7. Therefore, a magnetic field intensity is increased. This means that the magnetic field intensity generated by the coil 70 of the fuel injection valve 1 is the highest at the center portion W of the coil 70 in the axial direction.

In view of this point, in the present embodiment, since the first attractive surface is placed closer to the coil 70 in comparison to the second attractive surface in the axial direction, the first attractive surface is placed closer to the center portion W where the magnetic field intensity is high. Therefore, the magnetic attractive force can be improved in comparison to the movable core that has the first attractive surface and the second attractive surface, which are located at the same position in the axial direction.

When the movable core 41 is shaped into the stepped form as discussed above, the size of the movable core 41 is increased, and thereby the mass of the movable structure M is increased. As a result, the movable structure M is more likely to have the following bouncing phenomenon. Specifically, when the valve element 30 is seated against the seatable surface 23*s* through the valve closing movement of the movable structure M, the valve element 30 collides against the seatable surface 23*s* and is bounced from the seatable surface 23*s*, and this process of seating and bouncing is repeated. With respect to this phenomenon, according to the present embodiment, the modulus of longitudinal elasticity of the valve element 30 (the elongated shaft member) and the coupling member 31 (the elongated shaft member) is set to be larger than the modulus of longitudinal elasticity of the movable core 41. With this setting, the bouncing can be reduced in comparison to the case where the modulus of longitudinal elasticity of the movable core 41 and the modulus of longitudinal elasticity of the elongated shaft member are set to be equal to each other unlike to the present embodiment. A reason for this will be described with reference to FIGS. 8 and 9.

Figure 8:
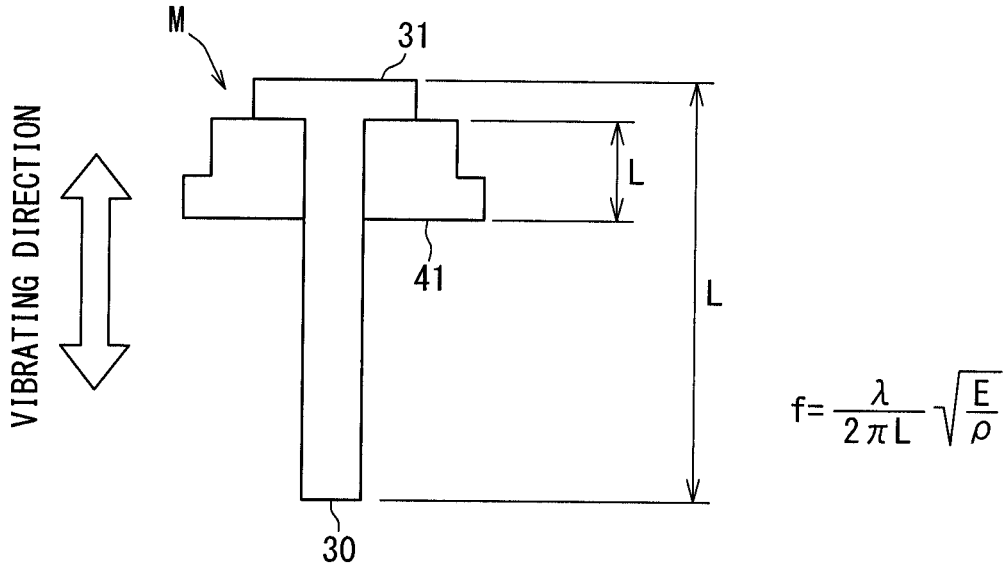
FIG. 8 is a diagram showing a model used in a numerical analysis of vibration of a movable structure.
Figure 9:
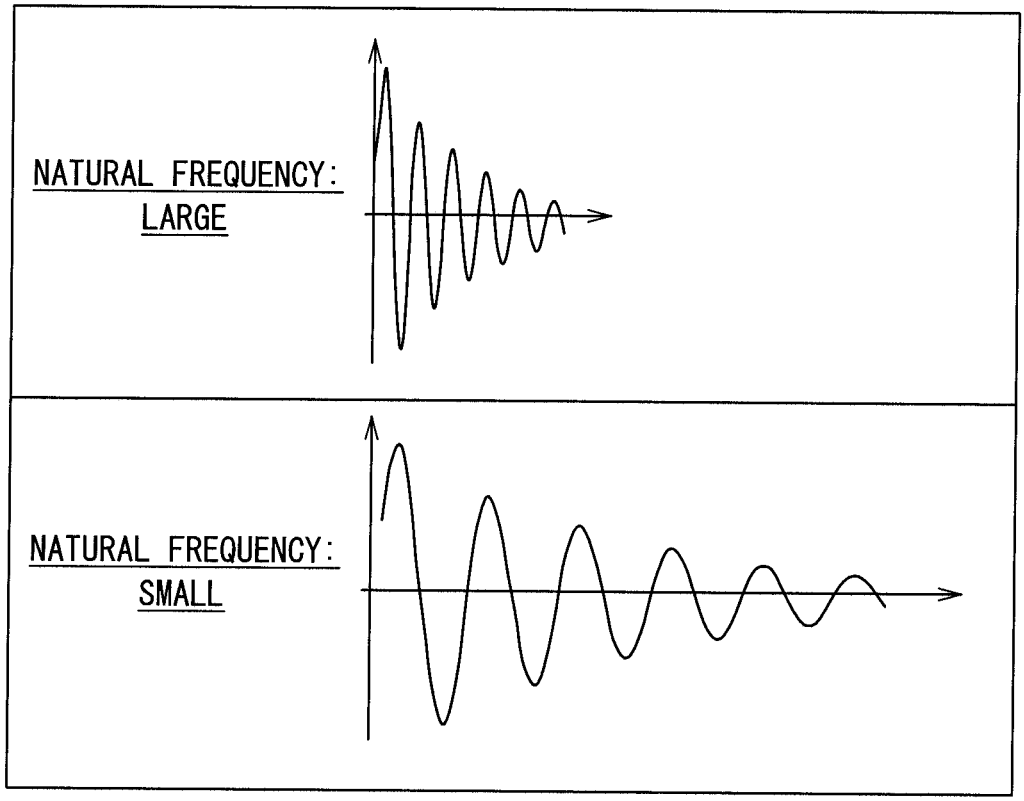
FIG. 9 is a diagram indicating a vibration waveform in the model of FIG. 8.

FIG. 8 shows a model used for a numerical analysis of the behavior of vibration that is generated at the time of occurrence of the bouncing of the movable structure M. In the equation of FIG. 8, f is a natural frequency, and λ is a dimensionless constant, and L is a length in the vibrating direction, and E is a longitudinal elastic modulus. FIG. 9 shows a vibration waveform of the above-described model. In FIG. 9, an axis of ordinates indicates the vibration intensity, and an axis of abscissas indicates an elapsed time. In a case of a model shown at the upper side of FIG. 9 where the natural frequency is large, a time period, which is required for the attenuation of the vibration, is shorter than that of a case of a model shown at the lower side of FIG. 9 where the natural frequency is small. Therefore, the increasing of the natural frequency of the movable structure M is effective for reducing the bouncing. As indicated by the equation in FIG. 8, the natural frequency f decreases as the length L in the vibrating direction increases, while the natural frequency f increases as the modulus of longitudinal elasticity E increases. Therefore, it is effective to increase the modulus of longitudinal elasticity E of the long portion of the movable structure M, which has the long axial length, in terms of increasing the natural frequency f of the movable structure M.

With respect to this point, according to the present embodiment, the modulus of longitudinal elasticity E of the elongated shaft member, which is longer than the movable core 41 in the axial direction, is set to be larger than the modulus of longitudinal elasticity E of the movable core 41. Therefore, the natural frequency f of the movable structure M can be increased, and thereby the time period, which is required for the attenuation of the bouncing vibration, can be reduced. Thus, the stepped form of the movable core 41 can implement both of increasing the magnetic attractive force and reducing the bouncing. Furthermore, the movable core 41, which forms the first attractive surface and the second attractive surface, can be made of the ferromagnetic material, through which the magnetic flux can easily pass, without having a restriction such as increasing of the modulus of longitudinal elasticity E. Thus, it is possible to achieve both of the increasing of the magnetic force and the limiting of the bouncing.

Furthermore, according to the present embodiment, the resilient member SP1, which is the coil spring, is entirely placed on the opposite side of the first attractive surface, which is opposite to the injection hole 23*a* in the axial direction. Here, in a case where a portion of the resilient member SP1 is placed on the injection hole 23*a* side of the first attractive surface in the axial direction unlike the present embodiment, the magnetic flux, which is generated by the energization, may possibly flow to the resilient member SP1 by bypassing an air gap formed at the first attractive surface. Furthermore, since the coil spring has an asymmetrical shape, the attractive force varies in the circumferential direction of the first attractive surface, so that the force for maintaining the movable core 41 at the full lift position is weakened. As a result, the valve closing speed of the movable structure M is increased, and the bouncing is promoted. In contrast, according to the present embodiment, the resilient member SP1 is entirely placed on the counter-injection-hole side of the first attractive surface, so that the bypassing described above can be limited to promote the increasing of the magnetic attractive force.

Furthermore, according to the present embodiment, the stationary boundary Q is covered by the cover body 90 from the radially inner side. Therefore, at the time of manufacturing the fuel injection valve 1, it is possible to limit the scattering of spatter particles, which are generated by the welding applied from the radially outer side, into the inside space of the second stationary core 51 and the body main portion 21 through the stationary boundary Q. In this case, it is possible to limit occurrence of malfunctioning of the fuel injection through the injection hole 23*a* caused by the presence of the spatter particles at the flow passages F26*s*, F31. Thereby, even when the second stationary core 51 and the body main portion 21 are welded together, the fuel can be appropriately injected.

Furthermore, according to the present embodiment, the resilient member SP1 contacts the orifice member 32. As described above, the resilient member SP1 contacts the portion of the movable structure M, which is other than the movable core 41 that has the lowest hardness in the movable structure M. Therefore, wearing of the movable structure M caused by the contacting of the resilient member SP1 is reduced. Thus, a reduction in the amount of resilient deformation of the resilient member SP1 caused by the wearing can be limited, and thereby an increase in the valve opening speed caused by the decrease in the resilient force of the resilient member SP1 can be limited. Thereby, it is possible to limit the phenomenon (the bouncing) where the enlarged diameter portion 31*a* repeatedly and continuously collide against the stopper 55 at the time of colliding the enlarged diameter portion 31*a* against the stopper 55 in response to the valve opening movement of the movable structure M.

Furthermore, according to the present embodiment, the movable core 41, which is shaped into the stepped core form, is used at the fuel injection valve 1 of the direct injection type that has the magnetic circuit surrounded by the cylinder head 3. In this way, an eddy current, which is generated at the cylinder head 3, can be reduced in comparison to the movable core, in which the single attractive surface is placed in the axial direction. This is due to the fact of that a desirable attractive force can be obtained by the smaller amount of magnetic flux. Therefore, the energy efficiency for generating the magnetic attractive force by the electric energy supplied to the coil 70 can be improved. Furthermore, in the case where the amount of magnetic flux can be reduced, it is possible to limit the amount of increase in the attractive force immediately before the time of contacting of the movable core 41 against the stationary core 50. In this way, the collision speed of the movable core 41 can be reduced, and thereby the valve-opening-time bouncing can be limited.

Furthermore, according to the present embodiment, the enlarged diameter portion 31*a* of the movable structure M under the valve opening movement contacts the stopper 55. In this contact state, a gap is generated between the movable core 41 and the stationary core. Therefore, the collision of the movable core 41 against the stationary core is avoided, and thereby a damage, which would be caused by the collision of the movable core 41, can be limited.

Furthermore, according to the present embodiment, the non-magnetic member 60 includes the upper tilt surface 60*a* and the lower tilt surface 60*b*. Therefore, at the time of assembling the non-magnetic member 60 to the first stationary core 50 and the second stationary core 51, the coaxial assembling of the non-magnetic member 60 can be highly accurately implemented. Thus, at the time of executing the valve opening/closing movement of the movable structure M, the fuel resistance, which is applied to the movable structure M, can be made uniform in the circumferential direction. In this way, it is possible to avoid the collision of the movable core 41 in a state where the movable core 41 is tilted. Thereby, the limiting of the bouncing can be promoted.

Second Embodiment

Figure 10:
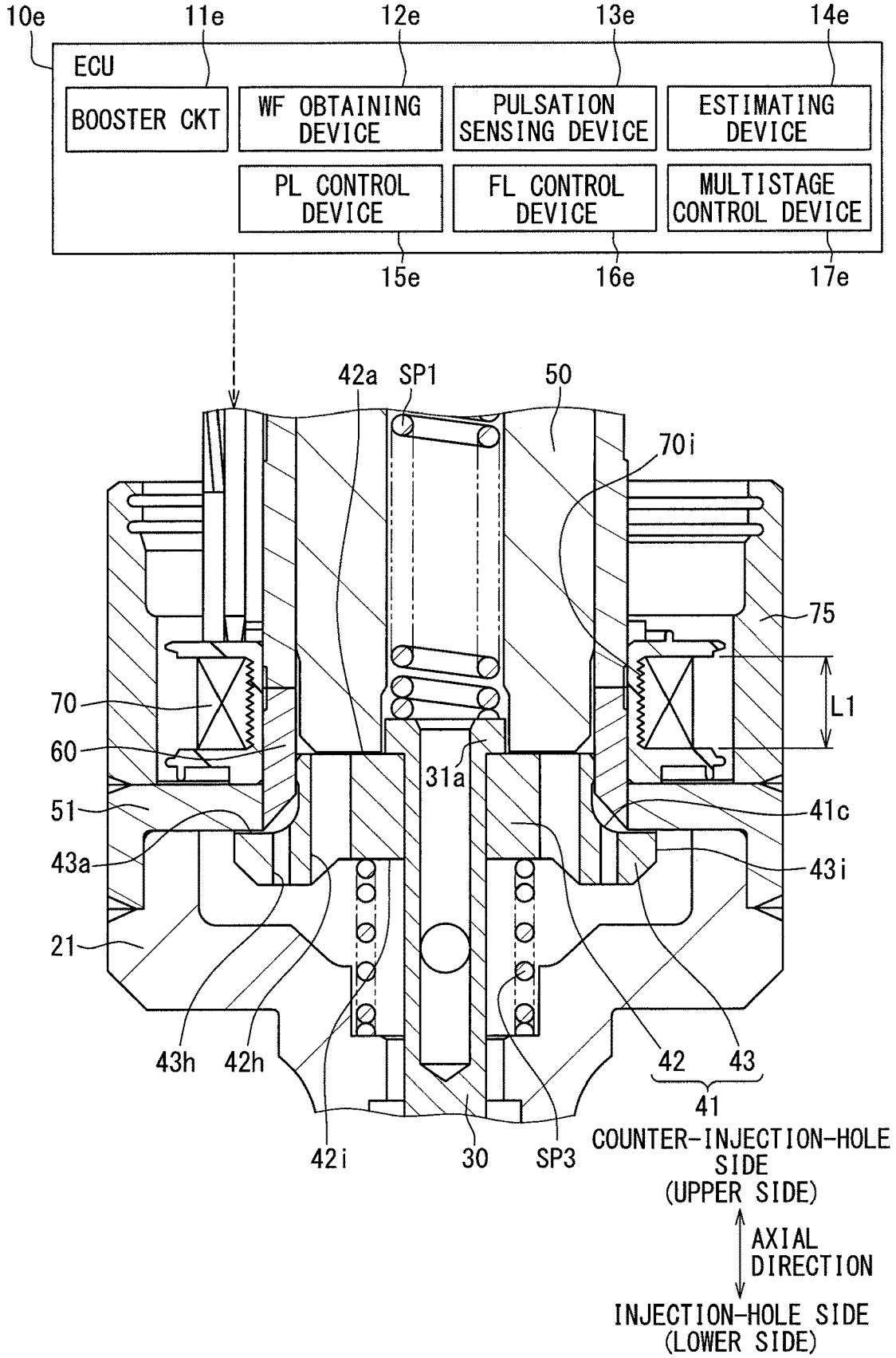
FIG. 10 is a cross-sectional view of a fuel injection valve according to a second embodiment of the present disclosure.

As shown in FIG. 10, in the present embodiment, the orifice member 32, the movable member 35 and the resilient urging member SP2 of the first embodiment are eliminated, and the coupling member 31 and the valve element 30 are formed integrally in one piece.

In the first embodiment, the coupling member 31 is fixed to the movable core 41 by welding. Specifically, the elongated shaft member and the movable core 41 are integrally bounced. In contrast, according to the present embodiment, the movable core 41 is assembled to the elongated shaft member in a state where the movable core 41 is movable relative to the coupling member 31 and the valve element 30 in the axial direction. A resilient member SP3 is clamped between the injection-hole-side surface of the movable core 41 and the body main portion 21. The resilient member SP3 applies the resilient force against the movable core 41 toward the counter-injection-hole side. In this way, the movable core 41 is clamped between the enlarged diameter portion 31*a* and the resilient member SP3.

At the time immediately after the contacting of the valve element 30 against the seatable surface 23*s* upon the valve closing movement of the movable structure M, the movable core 41 is moved toward the injection-hole side against the resilient force of the resilient member SP3. Specifically, the elongated shaft member, which includes the valve element 30, may be bounced in the state where the movable core 41 is moved relative to the elongated shaft member.

The movable inside 42 has a plurality of communication holes 42*h*. The communication holes 42*h* communicate between the injection-hole side of the movable core 41 and a gap, which is formed between the movable inside upper surface 42*a* and the first stationary core 50. The communication holes 42*h* are configured to extend through the movable core 41 in the axial direction and are arranged at equal intervals in the circumferential direction of the movable core 41.

A plurality of through-holes 43*h*, which extend through the movable core 41 in the axial direction, is formed at a connecting surface 41*c* of the movable core 41 that connects between the movable inside upper surface 42*a* (the first attractive surface) and the movable outside upper surface 43*a* (the second attractive surface). The through-holes 43*h* are configured to extend through the movable core 41 in the axial direction and are arranged at equal intervals in the circumferential direction of the movable core 41. In the example shown in FIG. 10, the through-holes 43*h* are respectively arranged at the same positions as those of the communication holes 42*h* in the circumferential direction of the movable core 41. Alternatively, the through-holes 43*h* may be arranged at the different positions that are different from the positions of the communication holes 42*h* in the circumferential direction of the movable core 41. Furthermore, in the example shown in FIG. 10, the through-holes 43*h* are formed at the movable outside 43. Alternatively, the through-holes 43*h* may be formed at the movable inside 42.

When the movable core 41 is attracted to the first stationary core 50 to cause the valve opening movement of the movable structure M, the fuel, which is located in a gap between the movable inside upper surface 42*a* and the first stationary core 50, is urged and is outputted from the communication holes 42*h* to the injection-hole side. Furthermore, the fuel, which is located between the connecting surface 41*c* and one of the second stationary core 51 and the non-magnetic member 60, is urged and is outputted from the through-holes 43*h* to the injection-hole side.

An injection-hole-side surface of the movable inside 42 has a recess 42*i*, which is recessed toward the counter-injection-hole side. Specifically, the injection-hole-side surface of the movable core 41 has the recess 42*i* that is formed by recessing one side of the injection-hole-side surface, which is adjacent to the elongated shaft member, in the direction away from the injection hole relative to another side of the injection-hole side surface, which is away from the elongated shaft member. The recess is formed in a range that includes the central axis, and the recess is shaped in a form of a circle in a view taken in the axial direction. An end portion of the resilient member SP3 is placed in the recess 42*i*, so that the recess 42*i* limits movement of the resilient member SP3 in the radial direction.

The magnetic flux, which enters the movable core 41 through the movable inside upper surface 42*a*, turns 180 degrees and exits from the movable core 41 through the movable outside upper surface 43*a*, as discussed above. Thereby, the magnetic flux makes a U-turn in the inside of the movable core 41. Due to the formation of the recess 42*i* at the injection-hole-side surface of the movable core 41, the change of the flow direction of the magnetic flux by the U-turn is promoted. In other words, a portion of the movable core 41, which is not involved in the magnetic flux passage that makes the U-turn, is removed by the recess 42*i*, so that a flow efficiency of the magnetic flux flow is improved. However, the recess 42*i* is sized such that the portion of the movable core 41, which is along the recess 42*i*, does not form a flow restricting portion, which restricts the flow of the magnetic flux in the magnetic circuit that includes the first stationary core 50, the second stationary core 51 and the movable core 41.

Furthermore, the non-magnetic member 60 is placed at a position where the non-magnetic member 60 is opposed to the connecting surface 41*c*. In other words, the non-magnetic member 60 is placed such that at least a portion of a range of the connecting surface 41*c* in the axial direction and at least a portion of a range of the inner peripheral surface of the non-magnetic member 60 in the axial direction are overlapped with each other.

Furthermore, a maximum outer diameter of the movable core 41 is set to be larger than an inner diameter of the coil 70. In other words, an outer peripheral surface of the movable core 41, i.e., an outer peripheral surface 43*i* of the movable outside 43 is placed on a radially outer side of a cylindrical inner peripheral surface 70*i* of the coil 70. Furthermore, a portion of the movable outside upper surface 43*a* is placed on a radially outer side of the cylindrical inner peripheral surface 70*i* of the coil 70.

Furthermore, an axial length L1 of the coil 70 is set to be smaller than an axial length of the movable core 41. Here, the axial length of the movable core 41 is defined as a distance from the upper surface of the movable inside 42 to a lower surface of the movable outside 43 in the axial direction. Furthermore, in the present embodiment, the axial length L1 of the coil 70 is set to be smaller than an axial length of the movable inside 42.

The energization of the coil 70 is controlled by an electronic control device (ECU 10*e*). The fuel injection valve 1 and the ECU 10*e* form a fuel injection system, and the ECU 10*e* forms a fuel injection control device. The ECU 10*e* includes a voltage booster circuit 11*e*, a waveform obtaining device 12*e*, a pulsation sensing device 13*e* and an estimating device 14*e*. The ECU 10*e* includes a processor, which serves as an arithmetic processing device, and a memory, which serves as a storage device. The processor executes various arithmetic processing operations according to a program stored in the memory.

The ECU 10*e* controls an energization time period, during which the coil 70 is energized, to control a valve opening time period of the valve element 30, so that an amount of fuel (a fuel injection amount) injected per valve opening operation is controlled. The energization time period can be set to a period, which is set to be so short thereby resulting in turning off of the energization of the coil 70 before reaching of the valve element 30 to the full lift position thereof, and this period is defined as a partial lift injection period. When the partial lift injection period is set as the energization time period of the coil 70, a minute amount of fuel can be injected. Furthermore, the energization time period can be set to another period, which is set to result in turned off of the energization of the coil after the reaching of the valve element 30 to the full lift position thereof, and this period is defined as a full lift injection period.

The ECU 10*e* includes a partial control device (hereinafter referred to as a PL control device 15*e*), which controls the injection in the partial lift injection period, and a full lift control device (hereinafter referred to as a FL control device 16*e*), which controls the injection in the full lift injection period. The ECU 10*e* switches the operation between the PL control device 15*e* and the FL control device 16*e* to control the length of the energization time period based on the required fuel injection amount and the fuel pressure supplied to the fuel injection valve 1. Furthermore, the ECU 10*e* includes a multistage control device 17*e* that controls the energization of the coil 70 such that a plurality of injections of the fuel is executed per combustion cycle.

The voltage booster circuit 11*e* boosts a battery voltage of a battery installed in the vehicle to generate a boosted voltage. The ECU 10*e* controls the energization of the coil 70 as follows. That is, the ECU 10*e* applies the boosted voltage to the coil 70 during a time period that is from a time point of starting the energization of the coil 70 to a time point, at which a value of the current is raised to a predetermined value. After this time period, the ECU 10*e* applies the battery voltage to the coil 70 until the end of the energization of the coil 70.

The waveform obtaining device 12*e* measures a current (a coil current) or a voltage (coil voltage) applied to the coil 70 and obtains a measurement waveform that indicates a temporal change in a measured value of the current or the voltage. An induced current is generated at the coil 70 while the movable core 41 is moved in response to the valve opening/closing movement of the movable structure M. Then, at the timing of stopping the movement of the movable core 41 after completion of the valve opening/closing movement of the movable structure M, a change occurs in the induced current, and thereby a pulsation is generated in the measurement waveform.

Therefore, the timing of ending the injection upon the completion of the valve closing movement or the timing of starting the valve closing movement is highly correlated with the timing of generating the pulsation in the measurement waveform. Furthermore, the timing of starting the injection upon the starting of the valve opening movement or the timing of reaching the full lift position upon the completion of the valve opening movement is highly correlated with the timing of generating the pulsation in the measurement waveform.

The pulsation sensing device 13*e* senses the timing of generating the pulsation in the measurement waveform, and the estimating device 14*e* estimates the timing of starting the injection or the timing of ending the injection based on the timing of generating the pulsation, which is sensed by the pulsation sensing device 13*e*. For example, the correlation between the timing of generating the pulsation and the timing of starting or ending the injection may be stored in advance in the ECU 10*e*. The estimating device 14*e* estimates the timing of starting or ending the injection based on the timing of generating the pulsation, which is sensed by the pulsation sensing device 13*e*, and the correlation discussed above. Furthermore, the estimating device 14*e* estimates the amount of fuel injected per valve opening movement based on at least one of the timing of starting the injection and the timing of ending the injection.

According to the present embodiment, the portion of the movable core 41, which includes the first attractive surface and extends in the moving direction (the axial direction), is referred to as the movable inside 42, and the recess 42*i*, which is recessed toward the counter-injection-hole side, is formed at the injection-hole-side surface of the movable inside 42. Therefore, the magnetic flux can easily make the U-turn in the inside of the movable core 41, and thereby the flow efficiency of the magnetic flux can be improved. Thus, the size of the attractive surface can be reduced by the amount that corresponds to the increase in the flow efficiency of the magnetic flux, and thereby the weight of the movable core 41 can be reduced. Furthermore, the weight of the movable core 41 can be reduced by the amount that corresponds to the amount of cut of the material of the movable core 41 at the recess 42*i*. Thereby, the limiting of the bouncing of the movable structure M can be enhanced.

Furthermore, according to the present embodiment, the movable core 41 is assembled to the elongated shaft member in the state where the movable core 41 is movable relative to the elongated shaft member in the moving direction (the axial direction). Therefore, when the movable structure M, which is under the valve closing movement, contacts the seatable surface 23*s*, the movable core 41 is moved relative to the valve element 30 toward the injection-hole side. Thus, the mass of the vibration system can be reduced, and thereby the bouncing of the valve element 30 can be limited. Furthermore, when the movable structure M, which is under the valve opening movement, contacts the first stationary core 50, the valve element 30 is moved relative to the movable core 41 toward the counter-injection-hole side. Thus, the mass of the vibration system can be reduced, and thereby the bouncing of the movable core 41 can be limited.

Furthermore, according to the present embodiment, in a case where the movable core 41 and the elongated shaft member are constructed to be movable relative to each other, it is possible to position the movable core 41 and the elongated shaft member such that a predetermined distance between the movable core 41 and the elongated shaft member in the operating direction is ensured in the non-operating state. In this way, it is possible to limit the valve reopening, which is caused by the recollision of the movable core 41 against the elongated shaft member, after the movement of the movable core 41 relative to the elongated shaft member upon the valve closing.

Furthermore, according to the present embodiment, the fuel injection system, which includes the waveform obtaining device 12*e*, the pulsation sensing device 13*e* and the estimating device 14*e*, is applied to the fuel injection valve 1 that includes the movable core 41 shaped into the stepped form. The waveform obtaining device 12*e* obtains the measurement waveform that indicates the temporal change in the measured value of the current or the voltage conducted through the coil 70. The pulsation sensing device 13*e* senses the timing of generating the pulsation in the measurement waveform, which is generated in response to the opening or closing of the injection hole 23*a* by the movable structure M. The estimating device 14*e* estimates the timing of starting or ending the injection of the fuel from the injection hole 23*a* based on the timing of generating the pulsation, which is sensed by the pulsation sensing device 13*e*. In the case of the movable core 41 that is shaped into the stepped form, a gap at the one attractive surface, into which the magnetic flux inflows, and a gap at the other attractive surface, from which the magnetic flux outflows, are simultaneously changed in response to the movement of the movable core 41. Therefore, the magnetic flux change, which is generated in response to the movement of the movable core 41, is increased, and thereby the pulsation becomes large. Therefore, according to the present embodiment, in which the device for estimating the valve opening/closing timing is used for the movable core 41 that is shaped into the stepped form, the estimation accuracy of the valve opening/closing timing can be improved.

Here, in the case where the movable core 41, which is shaped into the stepped form, is used like in the present embodiment, there is a deterioration in the fluidity of the fuel located between the stationary core and the connecting surface 41*c*, which connects between the first attractive surface and the second attractive surface. This is due to the fact of that the fuel, which is located at this location, cannot flow to the outside of the connecting surface 41*c* unless the fuel passes the first attractive surface and the second attractive surface at the time of valve closing movement, and the fuel cannot flow into this location from the outside of the connecting surface 41*c* unless the fuel passes the first attractive surface and the second attractive surface at the time of valve opening movement. In the case where the movable core 41 moves in the fuel that has the low fluidity, the apparent mass of the movable core 41 increases. As a result, the bouncing of the movable structure M is disadvantageously promoted.

In the present embodiment, which is made in view of this point, the through-holes 43*h*, which extend through the movable core 41 in the moving direction of the movable core 41, are formed at the connecting surface 41*c*, which connects between the first attractive surface and the second attractive surface of the movable core 41. Therefore, the fluidity of the fuel can be improved, and the increase in the apparent mass of the movable core 41 can be limited. Thus, the bouncing of the movable structure M can be limited.

In the case where the movable core 41, which is shaped into the stepped form, is used like in the present embodiment, a magnetic resistance in the magnetic circuit is increased due to the presence of the two attractive surfaces, which are respectively formed at the different locations in the axial direction. Thereby, a response time, which is a time period from a time point of starting the energization of the coil 70 to a time point of starting the valve opening movement of the valve element 30, is lengthened, and a change in the magnetic resistance, which occurs in response to the movement of the movable core 41, is also increased. Therefore, the attractive force is rapidly increased immediately before the reaching of the movable core 41 to the full lift position, so that the bouncing is disadvantageously promoted.

According to the present embodiment, which is made in view of the above point, in an initial time period, which is from the time of starting the energization, the boosted voltage, which is booted by the voltage booster circuit 11*e*, is applied to the coil 70. Therefore, it is possible to reduce a difference between the magnetic resistance, which is measured immediately before the reaching of the movable core 41 to the full lift position, and the magnetic resistance which is measured at the time of starting the valve opening. Thus, the change in the magnetic resistance, which occurs in response to the movement of the movable core 41, can be reduced. Therefore, the rapid increase in the attractive force immediately before the reaching of the movable core 41 to the full lift position can be limited, and thereby the bouncing of the movable structure M can be limited.

Here, in a case where an increase rate of the attractive force is low, a ratio of an attractive force increasing time period, during which the attractive force increases, relative to the energization time period becomes large. Particularly, in a case where the injection control operation is executed in the partial lift injection period, the ratio of the attractive force increasing time period is increased, and thereby the variation in the injection amount is increased relative to the variation in the energization time period. In the present embodiment, which is made in view of this point, the injection control operation in the partial lift injection period is used for the fuel injection valve 1 that includes the movable core 41, which is shaped into the stepped form. According to this, the magnetic efficiency is good due to the stepped form of the movable core 41, so that the increase rate of the attractive force can be increased. Thus, the ratio of the attractive force increasing time period can be reduced, and thereby the variation in the injection amount can be limited.

Furthermore, when the partial lift injection period, in which the valve closing movement begins before the reaching of the valve element 30 to the full lift position thereof, is set as the injection time period, it is possible to shorten a run-up time period, which is a time period required for the movable structure M to move to the seated position where the movable structure M is seated after the lifting thereof. Thus, by using the partial lift for the structure of the present disclosure, the valve-closing-time bouncing can be limited. Furthermore, the movable structure M does not contact the stationary core 50 at the partial lift, so that the valve-opening-time bouncing can be fundamentally addressed. Therefore, the partial lift is effective to address the disadvantage of the bouncing of the structure of the present disclosure.

In a case where the multistage injection operation is executed, an injection-to-injection interval is shortened. Therefore, it is required to rapidly dissipate the remanence of the magnetic circuit after completion of each injection. In the case where the movable core 41, which is shaped into the stepped form, is used like in the present embodiment, the remanence can be rapidly dissipated. Therefore, it is possible to limit occurrence of a change in the injection amount relative to the energization time period caused by the influence of the remanence. Furthermore, the injection amount per injection can be set to be small by the multistage injection operation. Thereby, the partial lift injection period can be used at a higher frequency, so it is possible to limit the variation in the injection amount, which would be caused by the valve-opening-time bouncing.

Here, as discussed above with reference to FIG. 7, the magnetic field intensity, which is generated by the coil 70, is the highest at the center portion W of the coil 70 in the axial direction. Also, the magnetic field intensity is the highest at a center portion of the coil 70 in the radial direction. In the present embodiment, which is made in view of the above point, at least the portion of the second attractive surface is placed on the radially outer side of the cylindrical inner peripheral surface 70*i* of the coil 70. Therefore, in comparison to a case where the entire second attractive surface is placed on the radially inner side of the cylindrical inner peripheral surface 70*i*, the second attractive surface is placed closer to the center portion of the coil 70 in the radial direction. Therefore, the magnetic attractive force can be increased. Furthermore, the size and the mass of the movable core 41 can be reduced by the amount that corresponds to the increase in the magnetic attractive force. Thus, the limiting of the bouncing can be enhanced.

Furthermore, according to the present embodiment, the non-magnetic member 60 is placed at the location where the non-magnetic member 60 is opposed to the connecting surface 41*c* that connects between the first attractive surface and the second attractive surface of the movable core 41. In this way, it is possible to limit occurrence of short circuiting of the magnetic flux that occurs when the magnetic flux, which enters the movable core 41 through one of the first attractive surface and the second attractive surface, flows into the stationary core while bypassing the other one of the first attractive surface and the second attractive surface. Therefore, the magnetic attractive force can be increased, and thereby the size and the mass of the movable core 41 can be reduced by the amount that corresponds to an increase in the magnetic attractive force. Thus, the limiting of the bouncing can be enhanced.

Other Embodiments

The embodiments of the present disclosure have been described. However, the present disclosure should not be limited to the above embodiments and can be applied to various embodiments and combinations of the embodiments without departing from the scope of the present disclosure.

In each of the above embodiments, the modulus of longitudinal elasticity of the elongated shaft member is set to be larger than the modulus of longitudinal elasticity of the movable core 41. Alternatively, the modulus of longitudinal elasticity of the elongated shaft member may be set to be smaller than the modulus of longitudinal elasticity of the movable core 41 or may be set to be the same as the modulus of longitudinal elasticity of the movable core 41.

In the first embodiment, the elongated shaft member, which has the modulus of longitudinal elasticity that is larger than the modulus of longitudinal elasticity of the movable core 41, includes the coupling member 31 and the valve element 30. Alternatively, the elongated shaft member may be configured to include the valve element 30 without including the coupling member 31, and the modulus of longitudinal elasticity of this elongated shaft member may be set as the modulus of longitudinal elasticity of the elongated shaft member. Further alternatively, the elongated shaft member may be configured to include only the coupling member 31 without including the valve element 30, and the modulus of longitudinal elasticity of this elongated shaft member may be set as the modulus of longitudinal elasticity of the elongated shaft member. Furthermore, the modulus of longitudinal elasticity of the valve element 30 may be set to be larger than the modulus of longitudinal elasticity of the coupling member 31.

The through-holes 43*h* shown in FIG. 10 are configured to extend in parallel with the axial direction. Alternatively, the through-holes 43*h* may be configured to extend obliquely relative to the axial direction. Furthermore, a metal material, which has a relatively high degree of magnetism, may be used as the material of the non-magnetic member 60 of each of the above embodiments. In such a case, a cross sectional area of the non-magnetic member 60 may be sufficiently reduced to serve as a flow restricting portion that restricts the flow of magnetic flux.

In each of the each of the above embodiments, the seatable surface 23*s* of the nozzle body 20 and the seat surface 30*s* of the valve element 30 are respectively shaped into the planar form. Alternatively, at least one of the seatable surface 23*s* and the seat surface 30*s* may be shaped into a spherical surface form or may have an arcuate cross section. In this way, the surface pressure, which is applied from the seatable surface 23*s* to the seat surface 30*s*, is reduced. Thus, the amount of resilient deformation of the valve element 30 at the time of seating the valve element 30 against the seatable surface 23*s* can be reduced, and the bouncing of the movable structure M can be reduced.

In each of the above embodiments, it is desirable that a hard film, which has a hardness higher than a hardness of the nozzle body 20 and/or a hardness of the valve element 30, is coated over at least one of the seatable surface 23*s* of the nozzle body 20 and the seat surface 30*s* of the valve element 30. As a specific example of the hard film, an amorphous nano-level thin film, which is made of hydrocarbon or an allotrope of carbon, may be used. In this way, the lubricity with respect to the friction between the seatable surface 23*s* and the seat surface 30*s* is improved, so that the bouncing of the movable structure M can be reduced.

In each of the above embodiments, the present disclosure is applied to the spark ignition gasoline engine, and the gasoline is used as the fuel to be injected from the fuel injection valve 1. Alternatively, a fuel, such as biofuel (e.g., ethanol, methanol), which has an energy density that is lower than an energy density of the gasoline, may be used. In a case where the fuel, which has the low energy density, is injected, the injection amount of the fuel needs to be increased to obtain the combustion energy that is equal to the combustion energy of the gasoline. Thus, the lift amount of the valve element 30 needs to be increased. In such a case, there is an increased possibility of bouncing of the movable structure M. However, according to the present disclosure that has the structure for reducing the bouncing discussed above, the bouncing can be advantageously limited. Thus, when the present disclosure is applied for the fuel that has the low energy density, the above advantage can be appropriately implemented.

In the first embodiment, the cover member 93, which serves as a covering portion, and the opposing member 94, which serves as the guiding portion, are formed as the separate members that are formed separately from the body main portion 21. Alternatively, the covering portion and the guiding portion may be formed by a portion of the body main portion 21.

The movable core 41 of each of the above embodiments may be configured such that instead of placing the movable outside upper surface 43*a* on the injection-hole side of the movable inside upper surface 42*a*, the movable outside upper surface 43*a* may be placed on the counter-injection-hole side of the movable inside upper surface 42*a*.

In each of the above embodiments, the cover upper chamber S1 is provided. Alternatively, the cover upper chamber S1 may be eliminated. For example, in the first embodiment, the cover upper surface 90*b* of the cover body 90 and the second lower surface 51*a* of the second stationary core 51 may be overlapped with each other, and the cover lower surface 90*c* of the cover body 90 and the upper end surface of the body main portion 21 may be overlapped with each other.

In the first embodiment, the main portion cutout N21 and the second cutout N51, which receive the cover body 90, are formed at the body main portion 21 and the second stationary core 51, respectively. Alternatively, these cutouts N21, N51 may be eliminated.

In the first embodiment, the cover member 93, the opposing member 94 and the body main portion 21 are made of the non-magnetic material. Alternatively, the cover member 93, the opposing member 94 and/or the body main portion 21 may be made of a magnetic material instead of the non-magnetic material. However, it is desirable that one of the cover member 93 and the body main portion 21 is made of the non-magnetic material or the like that has the relatively low degree of magnetism, which is lower than the degree of magnetism of the movable core 41 and/or the degree of magnetism of the second stationary core 51.

In the first embodiment, the cover body 90 includes the two members, i.e., the cover member 93 and the opposing member 94. Alternatively, the cover body 90 may include only the cover member 93.

In each of the above embodiments, when the movable structure M is moved in the valve closing direction, the cover upper chamber S1 implements the damper function. Alternatively, the cover upper chamber S1 may not implement the damper function. For example, instead of sliding the entire circumferential extent of the slide surface 33*a* of the slide member 33 relative to the opposing member 94, only a portion of the circumferential extent of the slide surface 33*a* of the slide member 33 may be slid relative to the opposing member 94.

In each of the above embodiments, the entire stationary boundary Q is included in the welding portion 96. However, it is only required that at least a radially outer end portion of the stationary boundary Q is included in the welding portion 96. In this configuration, the welding portion 96 includes the portion of the body main portion 21 and the portion of the second stationary core 51 but does not include the cover member 93. Specifically, the cover member 93 is not fixed to the body main portion 21 and the second stationary core 51 by the welding portion 96.

In the cover body 90 of the first embodiment, both of the cover member 93 and the opposing member 94 are made of the non-magnetic material. Alternatively, the opposing member 94 may be made of the magnetic material.

In each of the above embodiments, at the stationary boundary Q, the welding portion 96 is formed by the welding. Alternatively, the welding portion 96 may not be formed. Specifically, the second stationary core 51 and the body main portion 21 may not be welded together.

Figure 11:
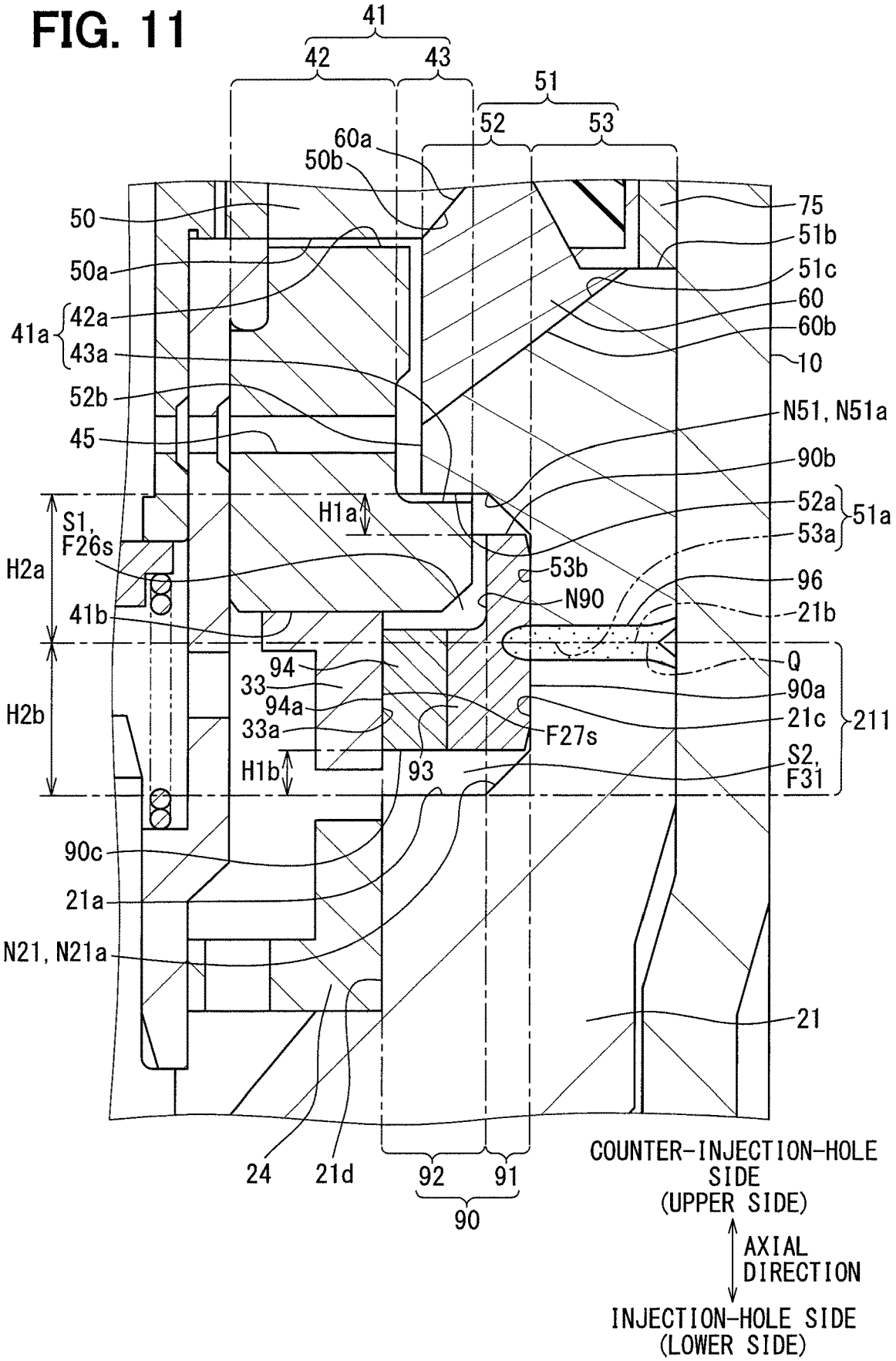
FIG. 11 is a cross-sectional view of a fuel injection valve according to another embodiment.

In each of the above embodiments, the portion of the stopper 55, which projects from the first stationary core 50 toward the injection-hole side, forms the projection that ensures the gap between the stationary core 50, 51 and the movable core 41. Alternatively, the projection may be formed at the movable structure M. For example, as shown in FIG. 11, at the movable structure M, a portion of the coupling member 31 projects from the movable core 41 toward the counter-injection-hole side, and this projecting portion of the coupling member 31 forms the projection. In this structure, the stopper 55 does not project from the first stationary core 50 toward the injection-hole side. Therefore, when the movement of the movable structure M is limited through the contact of the coupling member 31 against the stopper 55, the gap, which corresponds to the length of the projection of the coupling member 31 from the movable core 41, is ensured between the movable core 41 and each of the stationary cores 50, 51.

In each of the above embodiments, a size of the gap between the first attractive surface and the stationary core may be set to be the same as or different from a size of the gap between the second attractive surface and the stationary core. In the case where the sizes of these gaps are different from each other, it is desirable that one of the first attractive surface and the second attractive surface, which conducts the smaller amount of magnetic flux in comparison to the other one of the first attractive surface and the second attractive surface, has the larger size of the gap in comparison to the gap of the other one of the first attractive surface and the second attractive surface. This reason will be described below.

In a state where the fuel is filled in a form of thin film between the stationary core and the attractive surface, the attractive surface is not easily pulled off from the stationary core due to presence of linking. The strength of the linking is increased as the size of the gap between the stationary core and the attractive surface is reduced. Thereby, the responsiveness for starting of the valve closing movement relative to the turning off of the energization is deteriorated. However, when the size of the gap is increased to reduce the strength of the linking, the attractive force is reduced as a tradeoff. With respect to this point, even when the size of the gap is reduced at the attractive surface, which conducts the smaller amount of magnetic flux in comparison to the other attractive surface, the reduction in the size of the gap does not largely contribute to an increase in the attractive force. Therefore, it is more effective to reduce the strength of the linking by increasing the size of the gap.

Therefore, it is desirable to increase the size of the gap at the one of the first attractive surface and the second attractive surface, which conducts the smaller amount of magnetic flux in comparison to the other one of the first attractive surface and the second attractive surface. In each of the above embodiments, the amount of magnetic flux, which passes through the attractive surface (the second attractive surface) located on the radially outer side, is smaller than the amount of magnetic flux, which passes through the attractive surface (the first attractive surface) located on the radially inner side. Therefore, the size of the gap at the second attractive surface is set to be larger than the size of the gap at the first attractive surface.

Metal, which has a martensite structure, tends to have a larger modulus of longitudinal elasticity in comparison to metal, which has an austenitic structure. In view of this point, it is desirable that the metal, which has the martensite structure, is used as the material of the elongated shaft member, and the metal, which has the austenitic structure, is used as the material of the movable core 41. In this way, the modulus of longitudinal elasticity of the elongated shaft member can be easily set to be larger than the modulus of longitudinal elasticity of the movable core 41. Furthermore, it is desirable to use stainless steel as the material of the elongated shaft member and the movable core 41. For example, it is desirable that martensitic stainless steel is used as the material of the elongated shaft member, and austenitic stainless steel is used as the material of the movable core 41.

It is desirable that the steel, which contains chromium Cr, particularly stainless steel, which contains chromium, is used as the material of the elongated shaft member and the movable core 41. Furthermore, it is desirable that steel, which has a smaller chromium content in comparison to steel material used as the material of the movable core 41, is used as the material of the elongated shaft member. In this way, the modulus of longitudinal elasticity of the elongated shaft member can be easily set to be larger than the modulus of longitudinal elasticity of the movable core 41. For example, it is desirable that the chromium content of the elongated shaft member is less than 16%, and the chromium content of the movable core 41 is equal to or larger than 16%. It is more desirable that the chromium content of the elongated shaft member is equal to or larger than 12% and is less than 16%.

It is desirable that the hardness of the elongated shaft member is higher than the hardness of the movable core 41. In this way, the modulus of longitudinal elasticity of the elongated shaft member can be easily set to be larger than the modulus of longitudinal elasticity of the movable core 41. For example, it is desirable that the surface hardness of the elongated shaft member is equal to or higher than the Vickers hardness of 600, and the surface hardness of the movable core 41 is less than the Vickers hardness of 600.

Although the present disclosure has been described in view of the above embodiments, it should be understood that the present disclosure is not limited to the above embodiments and structures. The present disclosure also includes various modifications and variations within the equivalent range. In addition, various combinations and forms, and also other combinations and forms, each of which includes only one element or more or less, are within the scope of the present disclosure.

What is claimed is:

1. A fuel injection valve comprising:

a coil that is configured to generate a magnetic flux when the coil is energized;

a stationary core that is configured to form a passage of the magnetic flux and thereby generate a magnetic force; and a movable structure that includes a first attractive surface and a second attractive surface, which are configured to be attracted toward the stationary core by the magnetic force, wherein the movable structure is configured to be driven to open or close an injection hole, and the injection hole is configured to inject fuel when the movable structure is moved to open the injection hole in response to attraction of the first attractive surface and the second attractive surface toward the stationary core, wherein:

the first attractive surface and the second attractive surface are located at different locations, respectively, which are different from each other in a moving direction of the movable structure;

the movable structure includes:

a movable core that includes the first attractive surface and the second attractive surface; and an elongated shaft member that has a length, which is measured in the moving direction and is larger than a length of the movable core, which is measured in the moving direction; and a modulus of longitudinal elasticity of the elongated shaft member is larger than a modulus of longitudinal elasticity of the movable core.

2. The fuel injection valve according to claim 1, wherein:

the second attractive surface is located on an injection-hole side of the first attractive surface where the injection hole is located in the moving direction, and the second attractive surface is placed on an opposite side of the first attractive surface, which is opposite to the elongated shaft member in a direction that is perpendicular to the moving direction; and an injection-hole-side surface of the movable core, which is located on the injection-hole side, has a recess that is formed by recessing one side of the injection-hole-side surface, which is adjacent to the elongated shaft member, in a direction away from the injection hole relative to another side of the injection-hole side surface, which is away from the elongated shaft member.

3. The fuel injection valve according to claim 1, wherein the movable core is assembled to the elongated shaft member in a state where the movable core is movable relative to the elongated shaft member in the moving direction.

4. The fuel injection valve according to claim 1, wherein a through-hole, which extends through the movable core in the moving direction, is formed at a connecting surface of the movable core, which connects between the first attractive surface and the second attractive surface.

5. The fuel injection valve according to claim 1, comprising a coil spring that applies a resilient force to the movable structure in a valve closing direction, wherein:

the first attractive surface is located on an opposite side of the second attractive surface, which is opposite to the injection hole in the moving direction; and the coil spring is entirely placed on an opposite side of the first attractive surface, which is opposite to the injection hole in the moving direction.

6. The fuel injection valve according to claim 1, wherein:

the second attractive surface is located on an injection-hole side of the first attractive surface where the injection hole is located in the moving direction, and the second attractive surface is placed on an opposite side of the first attractive surface, which is opposite to the elongated shaft member in a direction that is perpendicular to the moving direction;

the coil is wound into a cylindrical form; and at least a portion of the second attractive surface is placed on a radially outer side of a cylindrical inner peripheral surface of the coil.

7. The fuel injection valve according to claim 1, wherein an inflow direction of the magnetic flux into the first attractive surface and an inflow direction of the magnetic flux into the second attractive surface are different from each other.

8. The fuel injection valve according to claim 1, comprising a coil spring that contacts the elongated shaft member and applies a resilient force against the movable structure in a valve closing direction, wherein:

the elongated shaft member has a hardness that is higher than a hardness of the movable core.

9. The fuel injection valve according to claim 1, wherein:

the fuel injection valve is configured to be inserted into an installation hole formed at an internal combustion engine and directly inject the fuel into a combustion chamber of the internal combustion engine;

the fuel injection valve comprises a case that receives the coil; and a region of the case, which receives the coil, is entirely surrounded by an inner peripheral surface of the installation hole.

10. The fuel injection valve according to claim 1, wherein:

a stopper is fixed to the stationary core to limit movement of the movable structure toward a side, which is opposite to the injection hole, through contact of the stopper with the movable structure; and in a state where the movable structure contacts the stopper, a gap is formed between the movable core and the stationary core.

11. The fuel injection valve according to claim 1, wherein:

the stationary core is one of a plurality of stationary cores that include a first stationary core, which is opposed to the first attractive surface, and a second stationary core, which is opposed to the second attractive surface; and the fuel injection valve comprises a non-magnetic member that is placed between the first stationary core and the second stationary core and has a degree of magnetism, which is lower than a degree of magnetism of the first stationary core and a degree of magnetism of the second stationary core.

12. The fuel injection valve according to claim 11, wherein:

the first stationary core includes a first tilt surface that is joined to the non-magnetic member and is shaped as a surface that is formed by tilting a surface, which is perpendicular to the moving direction; and the second stationary core includes a second tilt surface that is joined to the non-magnetic member and is shaped as a surface that is formed by tilting a surface, which is perpendicular to the moving direction.

13. The fuel injection valve according to claim 11, wherein the non-magnetic member is placed at a position where the non-magnetic member is opposed to a connecting surface of the movable core that connects between the first attractive surface and the second attractive surface.

14. The fuel injection valve according to claim 1, wherein a length of the coil, which is measured in the moving direction, is smaller than a length of the movable core, which is measured in the moving direction.

15. The fuel injection valve according to claim 1, comprising an injection hole member that has a seatable surface while a seat surface of the elongated shaft member is configured to be seated against and is lifted from the seatable surface, wherein at least one of the seatable surface and the seat surface is shaped into a spherical surface form or has an arcuate cross section.

16. The fuel injection valve according to claim 1, comprising an injection hole member that has a seatable surface while a seat surface of the elongated shaft member is configured to be seated against and is lifted from the seatable surface, wherein a hard film is coated over at least one of the seatable surface and the seat surface.

17. The fuel injection valve according to claim 1, wherein the fuel injection valve is configured to inject the fuel, which has an energy density that is smaller than an energy density of gasoline, through the injection hole.

18. A fuel injection system comprising:

the fuel injection valve of claim 1;

a waveform obtaining device that is configured to measure a current or a voltage to be applied to the coil and obtain a measurement waveform that indicates a temporal change in a measured value of the current or the voltage;

a pulsation sensing device that is configured to sense a timing of generating a pulsation in the measurement waveform, which is generated by stop of movement of the movable core; and an estimating device that is configured to estimate a timing of starting or ending injection of the fuel from the injection hole based on the timing of generating the pulsation, which is sensed by the pulsation sensing device.

19. A fuel injection system comprising:

the fuel injection valve of claim 1; and a voltage booster circuit that is configured to boost a battery voltage to generate a boosted voltage, wherein the boosted voltage is applied to the coil at least during a time period that is from a time point of starting energization of the coil to a time point, at which a value of a current conducted in the coil is raised to a predetermined value.

20. A fuel injection system comprising:

the fuel injection valve of claim 1; and a partial control device that is configured to control an energization time period of the coil such that the energization of the coil is turned off before a time point, at which the movable structure reaches a full lift position.

21. A fuel injection system comprising:

the fuel injection valve of claim 1; and a multistage control device that is configured to control energization of the coil such that a plurality of injections of the fuel is executed per combustion cycle of an internal combustion engine.

* * * * *